US010141004B2

(12) United States Patent
Koppens et al.

(10) Patent No.: US 10,141,004 B2
(45) Date of Patent: Nov. 27, 2018

(54) HYBRID WAVEFORM-CODED AND PARAMETRIC-CODED SPEECH ENHANCEMENT

(71) Applicants: DOLBY LABORATORIES LICENSING CORPORATION, San Francisco, CA (US); DOLBY INTERNATIONAL AB, Amsterdam Zuidoost (NL)

(72) Inventors: Jeroen Koppens, Södertälje (SE); Hannes Muesch, Oakland, CA (US)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 14/914,572

(22) PCT Filed: Aug. 27, 2014

(86) PCT No.: PCT/US2014/052962

§ 371 (c)(1),
(2) Date: Feb. 25, 2016

(87) PCT Pub. No.: WO2015/031505

PCT Pub. Date: Mar. 5, 2015

(65) Prior Publication Data

US 2016/0225387 A1 Aug. 4, 2016

Related U.S. Application Data

(60) Provisional application No. 61/908,664, filed on Nov. 25, 2013, provisional application No. 61/895,959,
(Continued)

(51) Int. Cl.
*G10L 21/0364* (2013.01)
*G10L 19/008* (2013.01)
(Continued)

(52) U.S. Cl.
CPC ..... *G10L 21/0364* (2013.01); *G10L 19/008* (2013.01); *G10L 19/20* (2013.01);
(Continued)

(58) Field of Classification Search
CPC . G10L 21/0364; G10L 21/0324; G10L 19/20; G10L 19/22; H04S 3/008;
(Continued)

(56) References Cited

U.S. PATENT DOCUMENTS 5,991,725 A * 11/1999 Asghar ..... G10L 21/0364 704/201
6,475,245 B2 * 11/2002 Gersho ..... G10L 19/10 704/208
(Continued)

FOREIGN PATENT DOCUMENTS

EP 2 118 892 11/2009
EP 2544465 A1 * 1/2013
(Continued)

OTHER PUBLICATIONS

Wang, DeLiang et al "Speech Intelligibility in Background Noise with Ideal Binary Time-Frequency Masking" pp. 2336-2347, J. Acoustical Society of America 125, Apr. 2009.
(Continued)

*Primary Examiner* — Yogeshkumar Patel

(57) ABSTRACT

A method for hybrid speech enhancement which employs parametric-coded enhancement (or blend of parametric-coded and waveform-coded enhancement) under some signal conditions and waveform-coded enhancement (or a different blend of parametric-coded and waveform-coded enhancement) under other signal conditions. Other aspects are methods for generating a bitstream indicative of an audio program including speech and other content, such that hybrid speech enhancement can be performed on the pro-
(Continued)

gram, a decoder including a buffer which stores at least one segment of an encoded audio bitstream generated by any embodiment of the inventive method, and a system or device (e.g., an encoder or decoder) configured (e.g., programmed) to perform any embodiment of the inventive method. At least some of speech enhancement operations are performed by a recipient audio decoder with Mid/Side speech enhancement metadata generated by an upstream audio encoder.

12 Claims, 9 Drawing Sheets

Related U.S. Application Data filed on Oct. 25, 2013, provisional application No. 61/870,933, filed on Aug. 28, 2013.

(51) Int. Cl.

| | |
|---|---|
| ***H04R 5/04*** | (2006.01) |
| ***G10L 19/20*** | (2013.01) |
| ***G10L 19/22*** | (2013.01) |
| ***G10L 21/0324*** | (2013.01) |
| ***H04S 3/00*** | (2006.01) |

(52) U.S. Cl.
CPC ..... *G10L 19/22* (2013.01); *G10L 21/0324* (2013.01); *H04R 5/04* (2013.01); *H04S 3/008* (2013.01); *H04S 2400/15* (2013.01); *H04S 2420/03* (2013.01)

(58) Field of Classification Search
CPC ..... H04S 2420/03; H04S 2400/15; H04S 2400/03; H04R 5/04
USPC ..... 704/270.1, E11.001, E15.039, E21.004, 704/228; 381/80, 119, 94.2, 22, 23
See application file for complete search history.

(56) References Cited

U.S. PATENT DOCUMENTS 6,691,082 B1 * 2/2004 Aguilar ..... G10L 19/0208 704/219
6,772,127 B2 * 8/2004 Saunders ..... H04S 3/00 381/10
6,898,566 B1 * 5/2005 Benyassine ..... G10L 19/22 704/207
6,928,169 B1 * 8/2005 Aylward ..... H04S 3/00 381/17
6,985,594 B1 * 1/2006 Vaudrey ..... H04R 3/005 381/104
7,039,581 B1 * 5/2006 Stachurski ..... G10L 19/20 704/205
7,080,007 B2 7/2006 Son
7,139,700 B1 * 11/2006 Stachurski ..... G10L 19/20 704/207
7,222,070 B1 * 5/2007 Stachurski ..... G10L 19/04 704/207
7,231,344 B2 6/2007 Chu
7,266,501 B2 * 9/2007 Saunders ..... G09B 5/04 381/10
7,415,120 B1 * 8/2008 Vaudrey ..... H03G 3/32 381/109
7,573,912 B2 * 8/2009 Lindblom ..... G10L 19/008 370/487
7,831,434 B2 * 11/2010 Mehrotra ..... G10L 21/038 381/21
7,840,410 B2 * 11/2010 Fellers ..... G10L 19/032 704/500
7,844,452 B2 11/2010 Takeuchi
8,108,220 B2 * 1/2012 Saunders ..... G09B 5/04 381/10
8,190,425 B2 * 5/2012 Mehrotra ..... H04S 3/008 704/203
8,260,611 B2 * 9/2012 Vos ..... G10L 19/0208 704/219
8,423,355 B2 * 4/2013 Mittal ..... G10L 19/20 704/203
8,428,936 B2 * 4/2013 Mittal ..... G10L 19/20 704/203
8,494,840 B2 7/2013 Muesch
8,600,737 B2 * 12/2013 Yang ..... G10L 21/038 704/205
8,891,778 B2 * 11/2014 Brown ..... G10L 21/0208 381/103
8,892,448 B2 * 11/2014 Vos ..... G10L 19/0208 704/223
8,929,558 B2 * 1/2015 Engdegard ..... G10L 19/008 381/17
9,043,214 B2 * 5/2015 Vos ..... G10L 19/0208 704/223
9,094,754 B2 * 7/2015 Engdegard ..... G10L 19/008
9,111,530 B2 * 8/2015 Purnhagen ..... G10L 19/008
9,129,600 B2 * 9/2015 Gibbs ..... G10L 19/20
9,159,326 B2 * 10/2015 Purnhagen ..... G10L 19/008
9,191,045 B2 * 11/2015 Purnhagen ..... G10L 19/008
9,224,403 B2 * 12/2015 Resch ..... G10L 19/107
9,237,400 B2 * 1/2016 Sehlstrom ..... G10L 21/0364
9,293,143 B2 * 3/2016 Villette ..... G10L 19/24
9,361,892 B2 * 6/2016 Kawashima ..... G10L 19/00
9,892,736 B2 * 2/2018 Purnhagen ..... G10L 19/008
2002/0116184 A1 * 8/2002 Gottsman ..... G10L 19/097 704/220
2002/0191715 A1 * 12/2002 Paksuniemi ..... H04M 1/6025 375/340
2003/0002683 A1 * 1/2003 Vaudrey ..... H04R 3/005 381/27
2004/0002856 A1 * 1/2004 Bhaskar ..... G10L 19/097 704/219
2004/0096065 A1 * 5/2004 Vaudrey ..... H04R 3/005 381/22
2004/0156397 A1 * 8/2004 Heikkinen ..... G10L 19/167 370/516
2004/0181398 A1 * 9/2004 Sung ..... G10L 19/24 704/219
2004/0213420 A1 * 10/2004 Gundry ..... H03G 7/004 381/104
2004/0213421 A1 * 10/2004 Jacobs ..... H04S 7/00 381/104
2005/0015242 A1 * 1/2005 Gracie ..... G01N 22/02 704/211
2005/0065782 A1 * 3/2005 Stachurski ..... B41F 27/1281 704/205
2005/0065786 A1 * 3/2005 Stachurski ..... B41F 27/1281 704/211
2005/0065787 A1 * 3/2005 Stachurski ..... B41F 27/1281 704/229
2005/0065788 A1 * 3/2005 Stachurski ..... G10L 19/20 704/229
2005/0091041 A1 * 4/2005 Ramo ..... G10L 19/24 704/205
2005/0105442 A1 * 5/2005 Melchior ..... H04R 3/12 369/83
2005/0114141 A1 * 5/2005 Grody ..... G10L 15/30 704/270
2005/0137858 A1 * 6/2005 Heikkinen ..... G10L 19/08 704/205
2005/0228648 A1 * 10/2005 Heikkinen ..... G10L 19/20 704/205
2005/0256702 A1 * 11/2005 Vadapalli ..... G10L 19/12 704/223
2006/0140412 A1 * 6/2006 Villemoes ..... G10L 19/008 381/12
2006/0215683 A1 * 9/2006 Sukkar ..... G10L 19/12 370/437
2006/0217969 A1 * 9/2006 Sukkar ..... H04B 3/23 704/219

(56) References Cited

U.S. PATENT DOCUMENTS

2006/0217970 A1* 9/2006 Sukkar ..... G10L 19/173 704/219
2006/0217971 A1* 9/2006 Sukkar ..... G10L 19/173 704/219
2006/0217972 A1* 9/2006 Sukkar ..... G10L 21/02 704/219
2006/0217974 A1* 9/2006 Sukkar ..... G10L 21/0205 704/225
2006/0217988 A1* 9/2006 Sukkar ..... G10L 19/173 704/500
2007/0073538 A1* 3/2007 Rifkin ..... G06K 9/6286 704/236
2007/0088545 A1* 4/2007 Zinser, Jr. ..... G10L 19/173 704/229
2007/0160154 A1* 7/2007 Sukkar ..... G10L 19/012 375/242
2008/0004883 A1* 1/2008 Vilermo ..... G10L 19/24 704/500
2008/0015867 A1* 1/2008 Kraemer ..... G10L 19/008 704/500
2008/0049943 A1* 2/2008 Faller ..... G10L 19/008 381/17
2008/0112568 A1* 5/2008 Sakuraba ..... H04M 9/082 381/66
2008/0165885 A1* 7/2008 Kondoz ..... H04K 1/00 375/295
2008/0181417 A1* 7/2008 Pereg ..... G10L 25/00 381/17
2008/0279394 A1* 11/2008 Isaka ..... H04S 1/00 381/94.7
2009/0030678 A1* 1/2009 Kovesi ..... G10L 19/032 704/230
2009/0067634 A1* 3/2009 Oh ..... H04S 3/008 381/17
2009/0076829 A1* 3/2009 Ragot ..... G10L 19/0208 704/500
2009/0147966 A1* 6/2009 McIntosh ..... H04R 3/005 381/71.11
2009/0182555 A1* 7/2009 Chang ..... G10L 21/0364 704/201
2009/0210239 A1* 8/2009 Yoon ..... G10L 19/008 704/500
2009/0228285 A1* 9/2009 Schnell ..... G10L 19/008 704/500
2009/0245539 A1* 10/2009 Vaudrey ..... H03G 7/002 381/109
2009/0252338 A1* 10/2009 Koppens ..... H04S 7/00 381/17
2009/0296961 A1* 12/2009 Takeuchi ..... G10L 21/02 381/110
2009/0299755 A1* 12/2009 Ragot ..... G10L 19/04 704/500
2009/0306992 A1* 12/2009 Ragot ..... G10L 19/24 704/500
2009/0326931 A1* 12/2009 Ragot ..... G10L 19/24 704/220
2010/0010807 A1* 1/2010 Oh ..... G10L 19/0204 704/200.1
2010/0027625 A1* 2/2010 Wik ..... G10L 19/002 375/240.12
2010/0034394 A1* 2/2010 Moon ..... G10L 21/0316 381/17
2010/0106507 A1* 4/2010 Muesch ..... H04R 25/356 704/270.1
2010/0121634 A1* 5/2010 Muesch ..... G10L 21/0205 704/224
2010/0145487 A1* 6/2010 Oh ..... G10L 19/008 700/94
2010/0217607 A1* 8/2010 Neuendorf ..... G10L 19/20 704/500
2010/0286990 A1* 11/2010 Biswas ..... G10L 19/035 704/500
2010/0286991 A1* 11/2010 Hedelin ..... G10L 19/035 704/500
2010/0332237 A1* 12/2010 Takeuchi ..... G10L 25/78 704/278
2011/0022402 A1* 1/2011 Engdegard ..... G10L 19/20 704/501
2011/0026581 A1* 2/2011 Ojala ..... G10L 19/24 375/240
2011/0046957 A1* 2/2011 Hertz ..... G10L 13/06 704/266
2011/0054887 A1* 3/2011 Muesch ..... H04R 5/04 704/225
2011/0106529 A1* 5/2011 Disch ..... G10L 19/0204 704/205
2011/0119055 A1* 5/2011 Lee ..... G10L 19/008 704/205
2011/0119061 A1* 5/2011 Brown ..... G10L 19/008 704/258
2011/0224976 A1* 9/2011 Taal ..... G10L 25/69 704/205
2011/0231185 A1 9/2011 Kleffner
2011/0249758 A1* 10/2011 Koppens ..... H04S 3/002 375/240.25
2011/0264456 A1* 10/2011 Koppens ..... G10L 19/008 704/500
2012/0029913 A1* 2/2012 Takeuchi ..... G10L 15/01 704/226
2012/0039477 A1* 2/2012 Schijers ..... G10L 19/008 381/22
2012/0177204 A1* 7/2012 Hellmuth ..... G10L 19/008 381/22
2012/0215529 A1* 8/2012 Cazi ..... G10L 21/0364 704/219
2012/0265534 A1* 10/2012 Coorman ..... G10L 13/033 704/265
2012/0300960 A1* 11/2012 Mackay ..... H04H 60/04 381/119
2012/0314876 A1* 12/2012 Vilkamo ..... G10L 19/008 381/22
2013/0006619 A1* 1/2013 Muesch ..... G10L 21/0208 704/225
2013/0028426 A1* 1/2013 Purnhagen ..... G10L 19/008 381/22
2013/0041673 A1* 2/2013 Nagel ..... G10L 21/038 704/500
2013/0121411 A1* 5/2013 Robillard ..... G10L 19/008 375/240.12
2013/0136282 A1* 5/2013 McClain ..... H03G 3/32 381/316
2013/0142339 A1* 6/2013 Engdegard ..... G10L 19/008 381/17
2013/0142340 A1* 6/2013 Sehlstrom ..... H04B 1/1676 381/17
2013/0142343 A1* 6/2013 Matsui ..... G10L 21/028 381/56
2013/0182875 A1* 7/2013 Cederberg ..... H04R 25/353 381/317
2013/0185065 A1* 7/2013 Tzirkel-Hancock .... G10L 15/20 704/233
2013/0185066 A1* 7/2013 Tzirkel-Hancock .... G10L 15/20 704/233
2013/0185078 A1* 7/2013 Tzirkel-Hancock .... G10L 15/22 704/275
2013/0211846 A1* 8/2013 Gibbs ..... G10L 19/20 704/500
2013/0272527 A1* 10/2013 Oomen ..... G10K 15/12 381/17
2014/0029766 A1* 1/2014 Gebauer ..... H04R 3/00 381/119
2014/0046656 A1* 2/2014 Michaelis ..... G10L 21/02 704/201
2014/0058737 A1* 2/2014 Ishikawa ..... G10L 19/20 704/500
2014/0074489 A1* 3/2014 Chong ..... G10L 19/20 704/500

(56) References Cited

U.S. PATENT DOCUMENTS

| | | | | |
|---|---|---|---|---|
| 2014/0105433 | A1* | 4/2014 | Goorevich | H04R 25/554 381/312 |
| 2014/0119545 | A1* | 5/2014 | Uhle | H04S 1/002 381/17 |
| 2014/0133683 | A1* | 5/2014 | Robinson | H04S 3/008 381/303 |
| 2014/0247945 | A1* | 9/2014 | Ramo | H04S 3/008 381/17 |
| 2014/0297296 | A1* | 10/2014 | Koppens | G10L 19/008 704/500 |
| 2014/0355767 | A1* | 12/2014 | Virette | G10L 19/008 381/22 |
| 2014/0358567 | A1* | 12/2014 | Koppens | G10L 19/008 704/500 |
| 2015/0163602 | A1* | 6/2015 | Pedersen | H04R 25/407 381/315 |
| 2015/0269953 | A1* | 9/2015 | Siami | G10L 21/0364 704/201 |
| 2016/0027446 | A1* | 1/2016 | Purnhagen | G10L 19/008 381/22 |
| 2016/0042742 | A1* | 2/2016 | Kjoerling | G10L 19/02 704/205 |
| 2016/0210974 | A1* | 7/2016 | Disch | G10L 19/025 |
| 2016/0329057 | A1* | 11/2016 | Purnhagen | G10L 19/008 |
| 2017/0221490 | A1* | 8/2017 | Sinai | G06F 3/162 |

FOREIGN PATENT DOCUMENTS

| | | |
|---|---|---|
| JP | 2001-245237 | 9/2001 |
| JP | 2008-301427 | 12/2008 |
| JP | 2009-194877 | 8/2009 |
| JP | 2013-521541 | 6/2013 |
| JP | 2014-535182 | 12/2014 |
| RU | 2461144 | 9/2012 |
| WO | 01/65888 | 9/2001 |
| WO | 2004/054320 | 6/2004 |
| WO | 2008/085703 | 7/2008 |
| WO | 2011/124616 | 10/2011 |

OTHER PUBLICATIONS

Mathers, C.D. "A Study of Sound Balances for the Hard of Hearing" BBC Research Department Report, 1991, Research Department, Engineering Division The British Broadcasting Corporation, pp. 1-12.

ETSI Draft, "Digital Audio Compression (AC-4) Standard: Draft ETSI TS 103 190" vol. Broadcast, No. VI.1.0, Nov. 20, 2013, pp. 1-252.

Robinson, C. et al "Dynamic Range Control via Metadata" presented at the 107th Convention Sep. 24-27, 1999, New York, pp. 1-14.

Bosi, M. et al "ISO/IEC MPEG-2 Advanced Audio Coding" Journal of the Audio Engineering Society, vol. 45, No. 10, pp. 789-814, Oct. 1997.

International Preliminary Report on Patentability in International Application No. PCT/US2014/052962, dated Mar. 12, 2015, 29 pages.

* cited by examiner

HYBRID WAVEFORM-CODED AND PARAMETRIC-CODED SPEECH ENHANCEMENT

CROSS REFERENCE TO RELATED APPLICATIONS

This application claims priority to U.S. Provisional Patent Application No. 61/870,933, filed on 28 Aug. 2013, U.S. Provisional Patent Application No. 61/895,959, filed on 25 Oct. 2013 and U.S. Provisional Patent Application No. 61/908,664, filed on 25 Nov. 2013, each of which is hereby incorporated by reference in its entirety.

TECHNOLOGY

The invention pertains to audio signal processing, and more particularly to enhancement of the speech content of an audio program relative to other content of the program, in which the speech enhancement is "hybrid" in the sense that it includes waveform-coded enhancement (or relatively more waveform-coded enhancement) under some signal conditions and parametric-coded enhancement (or relatively more parametric-coded enhancement) under other signal conditions. Other aspects are encoding, decoding, and rendering of audio programs which include data sufficient to enable such hybrid speech enhancement.

BACKGROUND

In movies and on television, dialog and narrative are often presented together with other, non-speech audio, such as music, effects, or ambiance from sporting events. In many cases the speech and non-speech sounds are captured separately and mixed together under the control of a sound engineer. The sound engineer selects the level of the speech in relation to the level of the non-speech in a way that is appropriate for the majority of listeners. However, some listeners, e.g., those with a hearing impairment, experience difficulties understanding the speech content of audio programs (having engineer-determined speech-to-non-speech mixing ratios) and would prefer if the speech were mixed at a higher relative level.

There exists a problem to be solved in allowing these listeners to increase the audibility of audio program speech content relative to that of non-speech audio content.

One current approach is to provide listeners with two high-quality audio streams. One stream carries primary content audio (mainly speech) and the other carries secondary content audio (the remaining audio program, which excludes speech) and the user is given control over the mixing process. Unfortunately, this scheme is impractical because it does not build on the current practice of transmitting a fully mixed audio program. In addition, it requires approximately twice the bandwidth of current broadcast practice because two independent audio streams, each of broadcast quality, must be delivered to the user.

Another speech enhancement method (to be referred to herein as "waveform-coded" enhancement) is described in US Patent Application Publication No. 2010/0106507 A1, published on Apr. 29, 2010, assigned to Dolby Laboratories, Inc. and naming Hannes Muesch as inventor. In waveform-coded enhancement, the speech to background (non-speech) ratio of an original audio mix of speech and non-speech content (sometimes referred to as a main mix) is increased by adding to the main mix a reduced quality version (low quality copy) of the clean speech signal which has been sent to the receiver alongside the main mix. To reduce bandwidth overhead, the low quality copy is typically coded at a very low bit rate. Because of the low bitrate coding, coding artifacts are associated with the low quality copy, and the coding artifacts are clearly audible when the low quality copy is rendered and auditioned in isolation. Thus, the low quality copy has objectionable quality when auditioned in isolation. Waveform-coded enhancement attempts to hide these coding artifacts by adding the low quality copy to the main mix only during times when the level of the non-speech components is high so that the coding artifacts are masked by the non-speech components. As will be detailed later, limitations of this approach include the following: the amount of speech enhancement typically cannot be constant over time, and audio artifacts may become audible when the background (non-speech) components of the main mix are weak or their frequency-amplitude spectrum differs drastically from that of the coding noise.

In accordance with waveform-coded enhancement, an audio program (for delivery to a decoder for decoding and subsequent rendering) is encoded as a bitstream which includes the low quality speech copy (or an encoded version thereof) as a sidestream of the main mix. The bitstream may include metadata indicative of a scaling parameter which determines the amount of waveform-coded speech enhancement to be performed (i.e., the scaling parameter determines a scaling factor to be applied to the low quality speech copy before the scaled, low quality speech copy is combined with the main mix, or a maximum value of such a scaling factor which will ensure masking of coding artifacts). When the current value of the scaling factor is zero, the decoder does not perform speech enhancement on the corresponding segment of the main mix. The current value of the scaling parameter (or the current maximum value that it may attain) is typically determined in the encoder (since it is typically generated by a computationally intensive psychoacoustic model), but it could be generated in the decoder. In the latter case, no metadata indicative of the scaling parameter would need to be sent from the encoder to the decoder, and the decoder instead could determine from the main mix a ratio of power of the mix's speech content to power of the mix and implement a model to determine the current value of the scaling parameter in response to the current value of the power ratio.

Another method (to be referred to herein as "parametric-coded" enhancement) for enhancing the intelligibility of speech in the presence of competing audio (background) is to segment the original audio program (typically a soundtrack) into time/frequency tiles and boost the tiles according to the ratio of the power (or level) of their speech and background content, to achieve a boost of the speech component relative to the background. The underlying idea of this approach is akin to that of guided spectral-subtraction noise suppression. In an extreme example of this approach, in which all tiles with SNR (i.e., ratio of power, or level, of the speech component to that of the competing sound content) below a predetermined threshold are completely suppressed, has been shown to provide robust speech intelligibility enhancements. In the application of this method to broadcasting, the speech to background ratio (SNR) may be inferred by comparing the original audio mix (of speech and non-speech content) to the speech component of the mix. The inferred SNR may then be transformed into a suitable set of enhancement parameters which are transmitted alongside the original audio mix. At the receiver, these parameters may (optionally) be applied to the original audio mix to derive a signal indicative of enhanced speech. As will be detailed later, parametric-coded enhancement functions best when the speech signal (the speech component of the mix) dominates the background signal (the non-speech component of the mix).

Waveform-coded enhancement requires that a low quality copy of the speech component of a delivered audio program is available at the receiver. To limit the data overhead incurred in transmitting that copy alongside the main audio mix, this copy is coded at a very low bitrate and exhibits coding distortions. These coding distortions are likely to be masked by the original audio when the level of the non-speech components is high. When the coding distortions are masked the resulting quality of the enhanced audio is very good.

Parametric-coded enhancement is based on the parsing of the main audio mix signal into time/frequency tiles and the application of suitable gains/attenuations to each of these tiles. The data rate needed to relay these gains to the receiver is low when compared to that of waveform-coded enhancement. However, due to limited temporal-spectral resolution of the parameters, speech, when mixed with non-speech audio, cannot be manipulated without also affecting the non-speech audio. Parametric-coded enhancement of the speech content of an audio mix thus introduces modulation in the non-speech content of the mix, and this modulation ("background modulation") may become objectionable upon playback of the speech-enhanced mix. Background modulations are most likely to be objectionable when the speech to background ratio is very low.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF DRAWINGS

The present invention is illustrated by way of example, and not by way of limitation, in the figures of the accompanying drawings and in which like reference numerals refer to similar elements and in which.

DESCRIPTION OF EXAMPLE EMBODIMENTS

Figure 1:
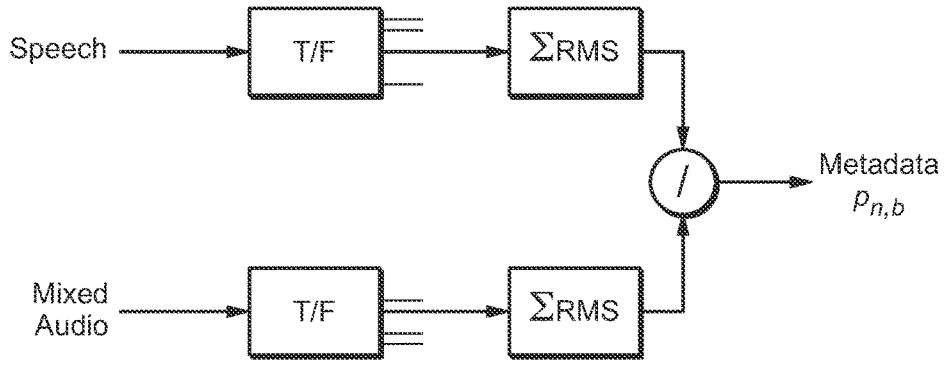
FIG. 1 is a block diagram of a system configured to generate prediction parameters for reconstructing the speech content of a single-channel mixed content signal (having speech and non-speech content).

Example embodiments, which relate to hybrid waveform-coded and parametric-coded speech enhancement, are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily occluding, obscuring, or obfuscating the present invention.

Example embodiments are described herein according to the following outline:

1. GENERAL OVERVIEW
2. NOTATION AND NOMENCLATURE
3. GENERATION OF PREDICTION PARAMETERS
4. SPEECH ENHANCEMENT OPERATIONS
5. SPEECH RENDERING
6. MID/SIDE REPRESENTATION
7. EXAMPLE PROCESS FLOWS
8. IMPLEMENTATION MECHANISMS—HARDWARE OVERVIEW
9. EQUIVALENTS, EXTENSIONS, ALTERNATIVES AND MISCELLANEOUS

1. General Overview

This overview presents a basic description of some aspects of an embodiment of the present invention. It should be noted that this overview is not an extensive or exhaustive summary of aspects of the embodiment. Moreover, it should be noted that this overview is not intended to be understood as identifying any particularly significant aspects or elements of the embodiment, nor as delineating any scope of the embodiment in particular, nor the invention in general. This overview merely presents some concepts that relate to the example embodiment in a condensed and simplified format, and should be understood as merely a conceptual prelude to a more detailed description of example embodiments that follows below. Note that, although separate embodiments are discussed herein, any combination of embodiments and/or partial embodiments discussed herein may be combined to form further embodiments.

The inventors have recognized that the individual strengths and weaknesses of parametric-coded enhancement and waveform-coded enhancement can offset each other, and that conventional speech enhancement can be substantially improved by a hybrid enhancement method which employs parametric-coded enhancement (or a blend of parametric-coded and waveform-coded enhancement) under some signal conditions and waveform-coded enhancement (or a different blend of parametric-coded and waveform-coded enhancement) under other signal conditions. Typical embodiments of the inventive hybrid enhancement method provide more consistent and better quality speech enhancement than can be achieved by either parametric-coded or waveform-coded enhancement alone.

In a class of embodiments, the inventive method includes the steps of: (a) receiving a bitstream indicative of an audio program including speech having an unenhanced waveform and other audio content, wherein the bitstream includes: audio data indicative of the speech and the other audio content, waveform data indicative of a reduced quality version of the speech (where the audio data has been generated by mixing speech data with non-speech data, the waveform data typically comprises fewer bits than does the speech data), wherein the reduced quality version has a second waveform similar (e.g., at least substantially similar) to the unenhanced waveform, and the reduced quality version would have objectionable quality if auditioned in isolation, and parametric data, wherein the parametric data with the audio data determines parametrically constructed speech, and the parametrically constructed speech is a parametrically reconstructed version of the speech which at least substantially matches (e.g., is a good approximation of) the speech; and (b) performing speech enhancement on the bitstream in response to a blend indicator, thereby generating data indicative of a speech-enhanced audio program, including by combining the audio data with a combination of low quality speech data determined from the waveform data, and reconstructed speech data, wherein the combination is determined by the blend indicator (e.g., the combination has a sequence of states determined by a sequence of current values of the blend indicator), the reconstructed speech data is generated in response to at least some of the parametric data and at least some of the audio data, and the speech-enhanced audio program has less audible speech enhancement artifacts (e.g., speech enhancement artifacts which are better masked and thus less audible when the speech-enhanced audio program is rendered and auditioned) than would either a purely waveform-coded speech-enhanced audio program determined by combining only the low quality speech data (which is indicative of the reduced quality version of the speech) with the audio data or a purely parametric-coded speech-enhanced audio program determined from the parametric data and the audio data.

Herein, "speech enhancement artifact" (or "speech enhancement coding artifact") denotes a distortion (typically a measurable distortion) of an audio signal (indicative of a speech signal and a non-speech audio signal) caused by a representation of the speech signal (e.g. waveform-coded speech signal, or parametric data in conjunction with the mixed content signal).

In some embodiments, the blend indicator (which may have a sequence of values, e.g., one for each of a sequence of bitstream segments) is included in the bitstream received in step (a). Some embodiments include a step of generating the blend indicator (e.g., in a receiver which receives and decodes the bitstream) in response to the bitstream received in step (a).

It should be understood that the expression "blend indicator" is not intended to require that the blend indicator is a single parameter or value (or a sequence of single parameters or values) for each segment of the bitstream. Rather, it is contemplated that in some embodiments, a blend indicator (for a segment of the bitstream) may be a set of two or more parameters or values (e.g., for each segment, a parametric-coded enhancement control parameter, and a waveform-coded enhancement control parameter) or a sequence of sets of parameters or values.

In some embodiments, the blend indicator for each segment may be a sequence of values indicating the blending per frequency band of the segment.

The waveform data and the parametric data need not be provided for (e.g., included in) each segment of the bitstream, and both the waveform data and the parametric data need not be used to perform speech enhancement on each segment of the bitstream. For example, in some cases at least one segment may include waveform data only (and the combination determined by the blend indicator for each such segment may consist of only waveform data) and at least one other segment may include parametric data only (and the combination determined by the blend indicator for each such segment may consist of only reconstructed speech data).

It is contemplated that typically, an encoder generates the bitstream including by encoding (e.g., compressing) the audio data, but not by applying the same encoding to the waveform data or the parametric data. Thus, when the bitstream is delivered to a receiver, the receiver would typically parse the bitstream to extract the audio data, the waveform data, and the parametric data (and the blend indicator if it is delivered in the bitstream), but would decode only the audio data. The receiver would typically perform speech enhancement on the decoded audio data (using the waveform data and/or parametric data) without applying to the waveform data or the parametric data the same decoding process that is applied to the audio data.

Typically, the combination (indicated by the blend indicator) of the waveform data and the reconstructed speech data changes over time, with each state of the combination pertaining to the speech and other audio content of a corresponding segment of the bitstream. The blend indicator is generated such that the current state of the combination (of waveform data and reconstructed speech data) is at least partially determined by signal properties of the speech and other audio content (e.g., a ratio of the power of speech content and the power of other audio content) in the corresponding segment of the bitstream. In some embodiments, the blend indicator is generated such that the current state of the combination is determined by signal properties of the speech and other audio content in the corresponding segment of the bitstream. In some embodiments, the blend indicator is generated such that the current state of the combination is determined both by signal properties of the speech and other audio content in the corresponding segment of the bitstream and an amount of coding artifacts in the waveform data.

Step (b) may include a step of performing waveform-coded speech enhancement by combining (e.g., mixing or blending) at least some of the low quality speech data with the audio data of at least one segment of the bitstream, and performing parametric-coded speech enhancement by combining the reconstructed speech data with the audio data of at least one segment of the bitstream. A combination of waveform-coded speech enhancement and parametric-coded speech enhancement is performed on at least one segment of the bitstream by blending both low quality speech data and parametrically constructed speech for the segment with the audio data of the segment. Under some signal conditions, only one (but not both) of waveform-coded speech enhancement and parametric-coded speech enhancement is performed (in response to the blend indicator) on a segment (or on each of more than one segments) of the bitstream.

Herein, the expression "SNR" (signal to noise ratio) will be used to denote the ratio of power (or difference in level) of the speech content of a segment of an audio program (or of the entire program) to that of the non-speech content of the segment or program, or of the speech content of a segment of the program (or the entire program) to that of the entire (speech and non-speech) content of the segment or program.

In a class of embodiments, the inventive method implements "blind" temporal SNR-based switching between parametric-coded enhancement and waveform-coded enhancement of segments of an audio program. In this context, "blind" denotes that the switching is not perceptually guided by a complex auditory masking model (e.g., of a type to be described herein), but is guided by a sequence of SNR values (blend indicators) corresponding to segments of the program. In one embodiment in this class, hybrid-coded speech enhancement is achieved by temporal switching between parametric-coded enhancement and waveform-coded enhancement, so that either parametric-coded enhancement or waveform-coded enhancement (but not both parametric-coded enhancement and waveform-coded enhancement) is performed on each segment of an audio program on which speech enhancement is performed. Recognizing that waveform-coded enhancement performs best under the condition of low SNR (on segments having low values of SNR) and parametric-coded enhancement performs best at favorable SNRs (on segments having high values of SNR), the switching decision is typically based on the ratio of speech (dialog) to remaining audio in an original audio mix.

Embodiments that implement "blind" temporal SNR-based switching typically include steps of: segmenting the unenhanced audio signal (original audio mix) into consecutive time slices (segments), and determining for each segment the SNR between the speech content and the other audio content (or between the speech content and total audio content) of the segment; and for each segment, comparing the SNR to a threshold and providing a parametric-coded enhancement control parameter for the segment (i.e., the blend indicator for the segment indicates that parametric-coded enhancement should be performed) when the SNR is greater than the threshold or providing a waveform-coded enhancement control parameter for the segment (i.e., the blend indicator for the segment indicates that waveform-coded enhancement should be performed) when the SNR is not greater than the threshold. Typically, the unenhanced audio signal is delivered (e.g., transmitted) with the control parameters included as metadata to a receiver, and the receiver performs (on each segment) the type of speech enhancement indicated by the control parameter for the segment. Thus, the receiver performs parametric-coded enhancement on each segment for which the control parameter is a parametric-coded enhancement control parameter, and waveform-coded enhancement on each segment for which the control parameter is a waveform-coded enhancement control parameter.

If one is willing to incur the cost of transmitting (with each segment of an original audio mix) both waveform data (for implementing waveform-coded speech enhancement) and parametric-coded enhancement parameters with an original (unenhanced) mix, a higher degree of speech enhancement can be achieved by applying both waveform-coded enhancement and parametric-coded enhancement to individual segments of the mix. Thus, in a class of embodiments, the inventive method implements "blind" temporal SNR-based blending between parametric-coded enhancement and waveform-coded enhancement of segments of an audio program. In this context also, "blind" denotes that the switching is not perceptually guided by a complex auditory masking model (e.g., of a type to be described herein), but is guided by a sequence of SNR values corresponding to segments of the program.

Embodiments that implement "blind" temporal SNR-based blending typically include steps of: segmenting the unenhanced audio signal (original audio mix) into consecutive time slices (segments), and determining for each segment the SNR between the speech content and the other audio content (or between the speech content and total audio content) of the segment; and for each segment, providing a blend control indicator, where the value of the blend control indicator is determined by (is a function of) the SNR for the segment.

In some embodiments, the method includes a step of determining (e.g., receiving a request for) a total amount ("T") of speech enhancement, and the blend control indicator is a parameter, $\alpha$, for each segment such that $T=\alpha Pw+(1-\alpha)Pp$, where Pw is waveform-coded enhancement for the segment that would produce the predetermined total amount of enhancement, T, if applied to unenhanced audio content of the segment using waveform data provided for the segment (where the speech content of the segment has an unenhanced waveform, the waveform data for the segment are indicative of a reduced quality version of the speech content of the segment, the reduced quality version has a waveform similar (e.g., at least substantially similar) to the unenhanced waveform, and the reduced quality version of the speech content is of objectionable quality when rendered and perceived in isolation), and Pp is parametric-coded enhancement that would produce the predetermined total amount of enhancement, T, if applied to unenhanced audio content of the segment using parametric data provided for the segment (where the parametric data for the segment, with the unenhanced audio content of the segment, determine a parametrically reconstructed version of the segment's speech content). In some embodiments, the blend control indicator for each of the segments is a set of such parameters, including a parameter for each frequency band of the relevant segment.

When the unenhanced audio signal is delivered (e.g., transmitted) with the control parameters as metadata to a receiver, the receiver may perform (on each segment) the hybrid speech enhancement indicated by the control parameters for the segment. Alternatively, the receiver generates the control parameters from the unenhanced audio signal.

In some embodiments, the receiver performs (on each segment of the unenhanced audio signal) a combination of parametric-coded enhancement (in an amount determined by the enhancement Pp scaled by the parameter $\alpha$ for the segment) and waveform-coded enhancement (in an amount determined by the enhancement Pw scaled by the value $(1-\alpha)$ for the segment), such that the combination of parametric-coded enhancement and waveform-coded enhancement generates the predetermined total amount of enhancement:

$$T=\alpha Pw+(1-\alpha)Pp \tag{1}$$

In another class of embodiments, the combination of waveform-coded and parametric-coded enhancement to be performed on each segment of an audio signal is determined by an auditory masking model. In some embodiments in this class, the optimal blending ratio for a blend of waveform-coded and parametric-coded enhancement to be performed on a segment of an audio program uses the highest amount of waveform-coded enhancement that just keeps the coding noise from becoming audible. It should be appreciated that coding noise availability in a decoder is always in the form of a statistical estimate, and cannot be determined exactly.

In some embodiments in this class, the blend indicator for each segment of the audio data is indicative of a combination of waveform-coded and parametric-coded enhancement to be performed on the segment, and the combination is at least substantially equal to a waveform-coded maximizing combination determined for the segment by the auditory masking model, where the waveform-coded maximizing combination specifies a greatest relative amount of waveform-coded enhancement that ensures that coding noise (due to waveform-coded enhancement) in the corresponding segment of the speech-enhanced audio program is not objectionably audible (e.g., is not audible). In some embodiments, the greatest relative amount of waveform-coded enhancement that ensures that coding noise in a segment of the speech-enhanced audio program is not objectionably audible is the greatest relative amount that ensures that the combination of waveform-coded enhancement and parametric-coded enhancement to be performed (on a corresponding segment of audio data) generates a predetermined total amount of speech enhancement for the segment, and/or (where artifacts of the parametric-coded enhancement are included in the assessment performed by the auditory masking model) it may allow coding artifacts (due to waveform-coded enhancement) to be audible (when this is favorable) over artifacts of the parametric-coded enhancement (e.g., when the audible coding artifacts (due to waveform-coded enhancement) are less objectionable than the audible artifacts of the parametric-coded enhancement).

The contribution of waveform-coded enhancement in the inventive hybrid coding scheme can be increased while ensuring that the coding noise does not become objectionably audible (e.g., does not become audible) by using an auditory masking model to predict more accurately how the coding noise in the reduced quality speech copy (to be used to implement waveform-coded enhancement) is being masked by the audio mix of the main program and to select the blending ratio accordingly.

Some embodiments which employ an auditory masking model include steps of: segmenting the unenhanced audio signal (original audio mix) into consecutive time slices (segments), and providing a reduced quality copy of the speech in each segment (for use in waveform-coded enhancement) and parametric-coded enhancement parameters (for use in parametric-coded enhancement) for each segment; for each of the segments, using the auditory masking model to determine a maximum amount of waveform-coded enhancement that can be applied without coding artifacts becoming objectionably audible; and generating an indicator (for each segment of the unenhanced audio signal) of a combination of waveform-coded enhancement (in an amount which does not exceed the maximum amount of waveform-coded enhancement determined using the auditory masking model for the segment, and which at least substantially matches the maximum amount of waveform-coded enhancement determined using the auditory masking model for the segment) and parametric-coded enhancement, such that the combination of waveform-coded enhancement and parametric-coded enhancement generates a predetermined total amount of speech enhancement for the segment.

In some embodiments, each indicator is included (e.g., by an encoder) in a bitstream which also includes encoded audio data indicative of the unenhanced audio signal.

In some embodiments, the unenhanced audio signal is segmented into consecutive time slices and each time slice is segmented into frequency bands, for each of the frequency bands of each of the time slices, the auditory masking model is used to determine a maximum amount of waveform-coded enhancement that can be applied without coding artifacts becoming objectionably audible, and an indicator is generated for each frequency band of each time slice of the unenhanced audio signal.

Optionally, the method also includes a step of performing (on each segment of the unenhanced audio signal) in response to the indicator for each segment, the combination of waveform-coded enhancement and parametric-coded enhancement determined by the indicator, such that the combination of waveform-coded enhancement and parametric-coded enhancement generates the predetermined total amount of speech enhancement for the segment.

In some embodiments, audio content is encoded in an encoded audio signal for a reference audio channel configuration (or representation) such as a surround sound configuration, a 5.1 speaker configuration, a 7.1 speaker configuration, a 7.2 speaker configuration, etc. The reference configuration may comprise audio channels such as stereo channels, left and right front channel, surround channels, speaker channels, object channels, etc. One or more of the channels that carry speech content may not be channels of a Mid/Side (M/S) audio channel representation. As used herein, an M/S audio channel representation (or simply M/S representation) comprises at least a mid-channel and a side-channel. In an example embodiment, the mid-channel represents a sum of left and right channels (e.g., equally weighted, etc.), whereas the side-channel represents a difference of left and right channels, wherein the left and right channels may be considered any combination of two channels, e.g. front-center and front-left channels.

In some embodiments, speech content of a program may be mixed with non-speech content and may be distributed over two or more non-M/S channels, such as left and right channels, left and right front channels, etc., in the reference audio channel configuration. The speech content may, but is not required to, be represented at a phantom center in stereo content in which the speech content is equally loud in two non-M/S channels such as left and right channels, etc. The stereo content may contain non-speech content that is not necessarily equally loud or that is even present in both of the two channels.

Under some approaches, multiple sets of non-M/S control data, control parameters, etc., for speech enhancement corresponding to multiple non-M/S audio channels over which the speech content is distributed are transmitted as a part of overall audio metadata from an audio encoder to downstream audio decoders. Each of the multiple sets of non-M/S control data, control parameters, etc., for speech enhancement corresponds to a specific audio channel of the multiple non-M/S audio channels over which the speech content is distributed and may be used by a downstream audio decoder to control speech enhancement operations relating to the specific audio channel. As used herein, a set of non-M/S control data, control parameters, etc., refers to control data, control parameters, etc., for speech enhancement operations in an audio channel of a non-M/S representation such as the reference configuration in which an audio signal as described herein is encoded.

In some embodiments, M/S speech enhancement metadata is transmitted—in addition to or in place of one or more sets of the non-M/S control data, control parameters, etc.—as a part of audio metadata from an audio encoder to downstream audio decoders. The M/S speech enhancement metadata may comprise one or more sets of M/S control data, control parameters, etc., for speech enhancement. As used herein, a set of M/S control data, control parameters, etc., refers to control data, control parameters, etc., for speech enhancement operations in an audio channel of the M/S representation. In some embodiments, the M/S speech enhancement metadata for speech enhancement is transmitted by an audio encoder to downstream audio decoders with the mixed content encoded in the reference audio channel configuration. In some embodiments, the number of sets of M/S control data, control parameters, etc., for speech enhancement in the M/S speech enhancement metadata may be fewer than the number of multiple non-M/S audio channels in the reference audio channel representation over which speech content in the mixed content is distributed. In some embodiments, even when the speech content in the mixed content is distributed over two or more non-M/S audio channels such as left and right channels, etc., in the reference audio channel configuration, only one set of M/S control data, control parameters, etc., for speech enhancement—e.g., corresponding to the mid-channel of the M/S representation—is sent as the M/S speech enhancement metadata by an audio encoder to downstream decoders. The single set of M/S control data, control parameters, etc., for speech enhancement may be used to accomplish speech enhancement operations for all of the two or more non-M/S audio channels such as the left and right channels, etc. In some embodiments, transformation matrices between the reference configuration and the M/S representation may be used to apply speech enhancement operations based on the M/S control data, control parameters, etc., for speech enhancement as described herein.

Techniques as described herein can be used in scenarios in which speech content is panned at the phantom center of left and right channels, speech content is not completely panned in the center (e.g., not equally loud in both left and right channels, etc.), etc. In an example, these techniques may be used in scenarios in which a large percentage (e.g., 70+%, 80+%, 90+%, etc.) of the energy of speech content is in the mid signal or mid-channel of the M/S representation. In another example, (e.g., spatial, etc.) transformations such as panning, rotations, etc., may be used to transform speech content unequaled in the reference configuration to be equal or substantially equal in the M/S configuration. Rendering vectors, transformation matrices, etc., representing panning, rotations, etc., may be used in as a part of, or in conjunction with, speech enhancement operations.

In some embodiments (e.g., a hybrid mode, etc.), a version (e.g., a reduced version, etc.) of the speech content is sent to a downstream audio decoder as either only a mid-channel signal or both mid-channel and side-channel signals in the M/S representation, along with the mixed content sent in the reference audio channel configuration possibly with a non-M/S representation. In some embodiments, when the version of the speech content is sent to a downstream audio decoder as only a mid-channel signal in the M/S representation, a corresponding rendering vector that operates (e.g., performs transformation, etc.) on the mid-channel signal to generate signal portions in one or more non-M/S channels of a non-M/S audio channel configuration (e.g., the reference configuration, etc.) based on the mid-channel signal is also sent to the downstream audio decoder.

In some embodiments, a dialog/speech enhancement algorithm (e.g., in a downstream audio decoder, etc.) that implements "blind" temporal SNR-based switching between parametric-coded enhancement (e.g., channel-independent dialog prediction, multichannel dialog prediction, etc.) and waveform-coded enhancement of segments of an audio program operates at least in part in the M/S representation.

Techniques as described herein that implement speech enhancement operations at least partially in the M/S representation can be used with channel-independent prediction (e.g., in the mid-channel, etc.), multichannel prediction (e.g., in the mid-channel and the side-channel, etc.), etc. These techniques can also be used to support speech enhancement for one, two or more dialogs at the same time. Zero, one or more additional sets of control parameters, control data, etc., such as prediction parameters, gains, rendering vectors, etc., can be provided in the encoded audio signal as a part of the M/S speech enhancement metadata to support additional dialogs.

In some embodiments, the syntax of the encoded audio signal (e.g., output from the encoder, etc.) supports a transmission of an M/S flag from an upstream audio encoder to downstream audio decoders. The M/S flag is present/set when speech enhancement operations are to be performed at least in part with M/S control data, control parameters, etc., that are transmitted with the M/S flag. For example, when the M/S flag is set, a stereo signal (e.g., from left and right channels, etc.) in non-M/S channels may be first transformed by a recipient audio decoder to the mid-channel and the side-channel of the M/S representation before applying M/S speech enhancement operations with the M/S control data, control parameters, etc., as received with the M/S flag, according to one or more of speech enhancement algorithms (e.g., channel-independent dialog prediction, multichannel dialog prediction, waveform-based, waveform-parametric hybrid, etc.). After the M/S speech enhancement operations are performed, the speech enhanced signals in the M/S representation may be transformed back to the non-M/S channels.

In some embodiments, the audio program whose speech content is to be enhanced in accordance with the invention includes speaker channels but not any object channel. In other embodiments, the audio program whose speech content is to be enhanced in accordance with the invention is an object based audio program (typically a multichannel object based audio program) comprising at least one object channel and optionally also at least one speaker channel.

Another aspect of the invention is a system including an encoder configured (e.g., programmed) to perform any embodiment of the inventive encoding method to generate a bitstream including encoded audio data, waveform data, and parametric data (and optionally also a blend indicator (e.g., blend indicating data) for each segment of the audio data) in response to audio data indicative of a program including speech and non-speech content, and a decoder configured to parse the bitstream to recover the encoded audio data (and optionally also each blend indicator) and to decode the encoded audio data to recover the audio data. Alternatively, the decoder is configured to generate a blend indicator for each segment of the audio data, in response to the recovered audio data. The decoder is configured to perform hybrid speech enhancement on the recovered audio data in response to each blend indicator.

Another aspect of the invention is a decoder configured to perform any embodiment of the inventive method. In another class of embodiments, the invention is a decoder including a buffer memory (buffer) which stores (e.g., in a non-transitory manner) at least one segment (e.g., frame) of an encoded audio bitstream which has been generated by any embodiment of the inventive method.

Other aspects of the invention include a system or device (e.g., an encoder, a decoder, or a processor) configured (e.g., programmed) to perform any embodiment of the inventive method, and a computer readable medium (e.g., a disc) which stores code for implementing any embodiment of the inventive method or steps thereof. For example, the inventive system can be or include a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and processing circuitry programmed (and/or otherwise configured) to perform an embodiment of the inventive method (or steps thereof) in response to data asserted thereto.

In some embodiments, mechanisms as described herein form a part of a media processing system, including but not limited to: an audiovisual device, a flat panel TV, a handheld device, game machine, television, home theater system, tablet, mobile device, laptop computer, netbook computer, cellular radiotelephone, electronic book reader, point of sale terminal, desktop computer, computer workstation, computer kiosk, various other kinds of terminals and media processing units, etc.

Various modifications to the preferred embodiments and the generic principles and features described herein will be readily apparent to those skilled in the art. Thus, the disclosure is not intended to be limited to the embodiments shown, but is to be accorded the widest scope consistent with the principles and features described herein.

2. Notation and Nomenclature

Throughout this disclosure, including in the claims, the terms "dialog" and "speech" are used interchangeably as synonyms to denote audio signal content perceived as a form of communication by a human being (or character in a virtual world).

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X-M inputs are received from an external source) may also be referred to as a decoder system.

Throughout this disclosure including in the claims, the term "processor" is used in a broad sense to denote a system or device programmable or otherwise configurable (e.g., with software or firmware) to perform operations on data (e.g., audio, or video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set.

Throughout this disclosure including in the claims, the expressions "audio processor" and "audio processing unit" are used interchangeably, and in a broad sense, to denote a system configured to process audio data. Examples of audio processing units include, but are not limited to encoders (e.g., transcoders), decoders, codecs, pre-processing systems, post-processing systems, and bitstream processing systems (sometimes referred to as bitstream processing tools).

Throughout this disclosure including in the claims, the expression "metadata" refers to separate and different data from corresponding audio data (audio content of a bitstream which also includes metadata). Metadata is associated with audio data, and indicates at least one feature or characteristic of the audio data (e.g., what type(s) of processing have already been performed, or should be performed, on the audio data, or the trajectory of an object indicated by the audio data). The association of the metadata with the audio data is time-synchronous. Thus, present (most recently received or updated) metadata may indicate that the corresponding audio data contemporaneously has an indicated feature and/or comprises the results of an indicated type of audio data processing.

Throughout this disclosure including in the claims, the term "couples" or "coupled" is used to mean either a direct or indirect connection. Thus, if a first device couples to a second device, that connection may be through a direct connection, or through an indirect connection via other devices and connections.

Throughout this disclosure including in the claims, the following expressions have the following definitions:

- speaker and loudspeaker are used synonymously to denote any sound-emitting transducer. This definition includes loudspeakers implemented as multiple transducers (e.g., woofer and tweeter);
- speaker feed: an audio signal to be applied directly to a loudspeaker, or an audio signal that is to be applied to an amplifier and loudspeaker in series;
- channel (or "audio channel"): a monophonic audio signal. Such a signal can typically be rendered in such a way as to be equivalent to application of the signal directly to a loudspeaker at a desired or nominal position. The desired position can be static, as is typically the case with physical loudspeakers, or dynamic;
- audio program: a set of one or more audio channels (at least one speaker channel and/or at least one object channel) and optionally also associated metadata (e.g., metadata that describes a desired spatial audio presentation);
- speaker channel (or "speaker-feed channel"): an audio channel that is associated with a named loudspeaker (at a desired or nominal position), or with a named speaker zone within a defined speaker configuration. A speaker channel is rendered in such a way as to be equivalent to application of the audio signal directly to the named loudspeaker (at the desired or nominal position) or to a speaker in the named speaker zone;
- object channel: an audio channel indicative of sound emitted by an audio source (sometimes referred to as an audio "object"). Typically, an object channel determines a parametric audio source description (e.g., metadata indicative of the parametric audio source description is included in or provided with the object channel). The source description may determine sound emitted by the source (as a function of time), the apparent position (e.g., 3D spatial coordinates) of the source as a function of time, and optionally at least one additional parameter (e.g., apparent source size or width) characterizing the source;

object based audio program: an audio program comprising a set of one or more object channels (and optionally also comprising at least one speaker channel) and optionally also associated metadata (e.g., metadata indicative of a trajectory of an audio object which emits sound indicated by an object channel, or metadata otherwise indicative of a desired spatial audio presentation of sound indicated by an object channel, or metadata indicative of an identification of at least one audio object which is a source of sound indicated by an object channel); and render: the process of converting an audio program into one or more speaker feeds, or the process of converting an audio program into one or more speaker feeds and converting the speaker feed(s) to sound using one or more loudspeakers (in the latter case, the rendering is sometimes referred to herein as rendering "by" the loudspeaker(s)). An audio channel can be trivially rendered ("at" a desired position) by applying the signal directly to a physical loudspeaker at the desired position, or one or more audio channels can be rendered using one of a variety of virtualization techniques designed to be substantially equivalent (for the listener) to such trivial rendering. In this latter case, each audio channel may be converted to one or more speaker feeds to be applied to loudspeaker(s) in known locations, which are in general different from the desired position, such that sound emitted by the loudspeaker(s) in response to the feed(s) will be perceived as emitting from the desired position. Examples of such virtualization techniques include binaural rendering via headphones (e.g., using Dolby Headphone processing which simulates up to 7.1 channels of surround sound for the headphone wearer) and wave field synthesis.

Embodiments of the inventive encoding, decoding, and speech enhancement methods, and systems configured to implement the methods will be described with reference to FIG. 3, FIG. 6, and FIG. 7.

3. Generation of Prediction Parameters

In order to perform speech enhancement (including hybrid speech enhancement in accordance with embodiments of the invention), it is necessary to have access to the speech signal to be enhanced. If the speech signal is not available (separately from a mix of the speech and non-speech content of the mixed signal to be enhanced) at the time speech enhancement is to be performed, parametric techniques may be used to create a reconstruction of the speech of the available mix.

One method for parametric reconstruction of speech content of a mixed content signal (indicative of a mix of speech and non-speech content) is based on reconstructing the speech power in each time-frequency tile of the signal, and generates parameters according to:

$$p_{n,b} = \sqrt{\sum_{s \in n, f \in b} \frac{D_{s,f}^2}{M_{s,f}^2}} \tag{2}$$

where $p_{n,b}$ is the parameter (parametric-coded speech enhancement value) for the tile having temporal index n and frequency banding index b, the value $D_{s,f}$ represents the speech signal in time-slot s and frequency bin f of the tile, the value $M_{s,f}$ represents the mixed content signal in the same time-slot and frequency bin of the tile, and the summation is over all values of s and f in all tiles. The parameters $p_{n,b}$ can be delivered (as metadata) with the mixed content signal itself, to allow a receiver to reconstruct the speech content of each segment of the mixed content signal.

As depicted in FIG. 1, each parameter $p_{n,b}$ can be determined by performing a time domain to frequency domain transform on the mixed content signal ("mixed audio") whose speech content is to be enhanced, performing a time domain to frequency domain transform on the speech signal (the speech content of the mixed content signal), integrating the energy (of each time-frequency tile having temporal index n and frequency banding index b of the speech signal) over all time-slots and frequency bins in the tile, and integrating the energy of the corresponding time-frequency tile of the mixed content signal over all time-slots and frequency bins in the tile, and dividing the result of the first integration by the result of the second integration to generate the parameter $p_{n,b}$ for the tile.

When each time-frequency tile of the mixed content signal is multiplied by the parameter $p_{n,b}$ for the tile, the resulting signal has similar spectral and temporal envelopes as the speech content of the mixed content signal.

Typical audio programs, e.g., stereo or 5.1 channel audio programs, include multiple speaker channels. Typically, each channel (or each of a subset of the channels) is indicative of speech and non-speech content, and a mixed content signal determines each channel. The described parametric speech reconstruction method can be applied independently to each channel to reconstruct the speech component of all channels. The reconstructed speech signals (one for each of the channels) can be added to the corresponding mixed content channel signals, with an appropriate gain for each channel, to achieve a desired boost of the speech content.

The mixed content signals (channels) of a multi-channel program can be represented as a set of signal vectors, where each vector element is a collection of time-frequency tiles corresponding to a specific parameter set, i.e., all frequency bins (f) in the parameter band (b) and time-slots (s) in the frame (n). An example of such a set of vectors, for a three-channel mixed content signal is:

$$M_{n,b} = \begin{pmatrix} M_{c_1,n,b} \\ M_{c_2,n,b} \\ M_{c_3,n,b} \end{pmatrix} \tag{3}$$

where $c_i$ indicates the channel. The example assumes three channels, but the number of channels is an arbitrary amount.

Similarly the speech content of a multi-channel program can be represented as a set of 1×1 matrices (where the speech content consists of only one channel), $D_{n,b}$. Multiplication of each matrix element of the mixed content signal with a scalar value results in a multiplication of each sub-element with the scalar value. A reconstructed speech value for each tile is thus obtained by calculating $$D_{r,n,b}=\text{diag}(P)\cdot M_{n,b} \quad (4)$$

for each n and b, where P is a matrix whose elements are prediction parameters. The reconstructed speech (for all the tiles) can also be denoted as:

$$D_r=\text{diag}(P)\cdot M \quad (5)$$

Figure 2:
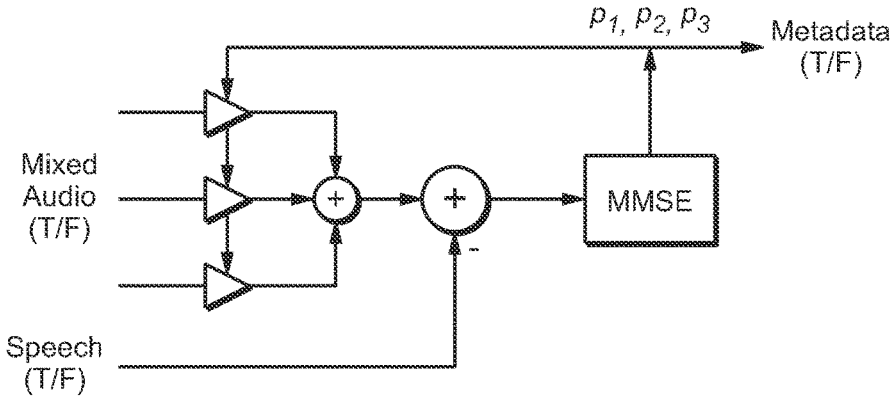
FIG. 2 is a block diagram of a system configured to generate prediction parameters for reconstructing the speech content of a multi-channel mixed content signal (having speech and non-speech content).

The content in the multiple channels of a multi-channel mixed content signal causes correlations between the channels that can be employed to make a better prediction of the speech signal. By employing a Minimum Mean Square Error (MMSE) predictor (e.g., of a conventional type), the channels can be combined with prediction parameters so as to reconstruct the speech content with a minimum error according to the Mean Square Error (MSE) criterion. As shown in FIG. 2, assuming a three-channel mixed content input signal, such an MMSE predictor (operating in the frequency domain) iteratively generates a set of prediction parameters $p_i$ (where index i is 1, 2, or 3) in response to the mixed content input signal and a single input speech signal indicative of the speech content of the mixed content input signal.

A speech value reconstructed from a tile of each channel of the mixed content input signal (each tile having the same indices n and b) is a linear combination of the content ($M_{ci,n,b}$) of each channel (i=1, 2, or 3) of the mixed content signal controlled by a weight parameter for each channel. These weight parameters are the prediction parameters, $p_i$, for the tiles having the same indices n and b. Thus, the speech reconstructed from all the tiles of all channels of the mixed content signal is:

$$D_r=p_1\cdot M_{c1}+p_2\cdot M_{c2}+p_3\cdot M_{c3} \quad (6)$$

or in signal matrix form:

$$D_r=PM \quad (7)$$

For example, when speech is coherently present in multiple channels of the mixed content signal whereas background (non-speech) sounds are incoherent between the channels, an additive combination of channels will favor the energy of the speech. For two channels this results in a 3 dB better speech separation compared to the channel independent reconstruction. As another example, when the speech is present in one channel and background sounds are coherently present in multiple channels, a subtractive combination of channels will (partially) eliminate the background sounds whereas the speech is preserved.

In a class of embodiments, the inventive method includes the steps of: (a) receiving a bitstream indicative of an audio program including speech having an unenhanced waveform and other audio content, wherein the bitstream includes: unenhanced audio data indicative of the speech and the other audio content, waveform data indicative of a reduced quality version of the speech, wherein the reduced quality version of the speech has a second waveform similar (e.g., at least substantially similar) to the unenhanced waveform, and the reduced quality version would have objectionable quality if auditioned in isolation, and parametric data, wherein the parametric data with the unenhanced audio data determines parametrically constructed speech, and the parametrically constructed speech is a parametrically reconstructed version of the speech which at least substantially matches (e.g., is a good approximation of) the speech; and (b) performing speech enhancement on the bitstream in response to a blend indicator, thereby generating data indicative of a speech-enhanced audio program, including by combining the unenhanced audio data with a combination of low quality speech data determined from the waveform data, and reconstructed speech data, wherein the combination is determined by the blend indicator (e.g., the combination has a sequence of states determined by a sequence of current values of the blend indicator), the reconstructed speech data is generated in response to at least some of the parametric data and at least some of the unenhanced audio data, and the speech-enhanced audio program has less audible speech enhancement coding artifacts (e.g., speech enhancement coding artifacts which are better masked) than would either a purely waveform-coded speech-enhanced audio program determined by combining only the low quality speech data with the unenhanced audio data or a purely parametric-coded speech-enhanced audio program determined from the parametric data and the unenhanced audio data.

In some embodiments, the blend indicator (which may have a sequence of values, e.g., one for each of a sequence of bitstream segments) is included in the bitstream received in step (a). In other embodiments, the blend indicator is generated (e.g., in a receiver which receives and decodes the bitstream) in response to the bitstream.

It should be understood that the expression "blend indicator" is not intended to denote a single parameter or value (or a sequence of single parameters or values) for each segment of the bitstream. Rather, it is contemplated that in some embodiments, a blend indicator (for a segment of the bitstream) may be a set of two or more parameters or values (e.g., for each segment, a parametric-coded enhancement control parameter and a waveform-coded enhancement control parameter). In some embodiments, the blend indicator for each segment may be a sequence of values indicating the blending per frequency band of the segment.

The waveform data and the parametric data need not be provided for (e.g., included in) each segment of the bitstream, or used to perform speech enhancement on each segment of the bitstream. For example, in some cases at least one segment may include waveform data only (and the combination determined by the blend indicator for each such segment may consist of only waveform data) and at least one other segment may include parametric data only (and the combination determined by the blend indicator for each such segment may consist of only reconstructed speech data).

It is contemplated that in some embodiments, an encoder generates the bitstream including by encoding (e.g., compressing) the unenhanced audio data, but not the waveform data or the parametric data. Thus, when the bitstream is delivered to a receiver, the receiver would parse the bitstream to extract the unenhanced audio data, the waveform data, and the parametric data (and the blend indicator if it is delivered in the bitstream), but would decode only the unenhanced audio data. The receiver would perform speech enhancement on the decoded, unenhanced audio data (using the waveform data and/or parametric data) without applying to the waveform data or the parametric data the same decoding process that is applied to the audio data.

Typically, the combination (indicated by the blend indicator) of the waveform data and the reconstructed speech data changes over time, with each state of the combination pertaining to the speech and other audio content of a corresponding segment of the bitstream. The blend indicator is generated such that the current state of the combination (of waveform data and reconstructed speech data) is determined by signal properties of the speech and other audio content (e.g., a ratio of the power of speech content and the power of other audio content) in the corresponding segment of the bitstream.

Step (b) may include a step of performing waveform-coded speech enhancement by combining (e.g., mixing or blending) at least some of the low quality speech data with the unenhanced audio data of at least one segment of the bitstream, and performing parametric-coded speech enhancement by combining reconstructed speech data with the unenhanced audio data of at least one segment of the bitstream. A combination of waveform-coded speech enhancement and parametric-coded speech enhancement is performed on at least one segment of the bitstream by blending both low quality speech data and reconstructed speech data for the segment with the unenhanced audio data of the segment. Under some signal conditions, only one (but not both) of waveform-coded speech enhancement and parametric-coded speech enhancement is performed (in response to the blend indicator) on a segment (or on each of more than one segments) of the bitstream.

4. Speech Enhancement Operations

Herein, "SNR" (signal to noise ratio) is used to denote the ratio of power (or level) of the speech component (i.e., speech content) of a segment of an audio program (or of the entire program) to that of the non-speech component (i.e., the non-speech content) of the segment or program or to that of the entire (speech and non-speech) content of the segment or program. In some embodiments, SNR is derived from an audio signal (to undergo speech enhancement) and a separate signal indicative of the audio signal's speech content (e.g., a low quality copy of the speech content which has been generated for use in waveform-coded enhancement). In some embodiments, SNR is derived from an audio signal (to undergo speech enhancement) and from parametric data (which has been generated for use in parametric-coded enhancement of the audio signal).

In a class of embodiments, the inventive method implements "blind" temporal SNR-based switching between parametric-coded enhancement and waveform-coded enhancement of segments of an audio program. In this context, "blind" denotes that the switching is not perceptually guided by a complex auditory masking model (e.g., of a type to be described herein), but is guided by a sequence of SNR values (blend indicators) corresponding to segments of the program. In one embodiment in this class, hybrid-coded speech enhancement is achieved by temporal switching between parametric-coded enhancement and waveform-coded enhancement (in response to a blend indicator, e.g., a blend indicator generated in subsystem 29 of the encoder of FIG. 3, which indicates that either parametric-coded enhancement only or waveform-coded enhancement should be performed on corresponding audio data), so that either parametric-coded enhancement or waveform-coded enhancement (but not both parametric-coded enhancement and waveform-coded enhancement) is performed on each segment of an audio program on which the speech enhancement is performed. Recognizing that waveform-coded enhancement performs best under the condition of low SNR (on segments having low values of SNR) and parametric-coded enhancement performs best at favorable SNRs (on segments having high values of SNR), the switching decision is typically based on the ratio of speech (dialog) to remaining audio in an original audio mix.

Embodiments that implement "blind" temporal SNR-based switching typically include steps of: segmenting the unenhanced audio signal (original audio mix) into consecutive time slices (segments), and determining for each segment the SNR between the speech content and the other audio content (or between the speech content and total audio content) of the segment; and for each segment, comparing the SNR to a threshold and providing a parametric-coded enhancement control parameter for the segment (i.e., the blend indicator for the segment indicates that parametric-coded enhancement should be performed) when the SNR is greater than the threshold or providing a waveform-coded enhancement control parameter for the segment (i.e., the blend indicator for the segment indicates that waveform-coded enhancement should be performed) when the SNR is not greater than the threshold.

When the unenhanced audio signal is delivered (e.g., transmitted) with the control parameters included as metadata to a receiver, the receiver may perform (on each segment) the type of speech enhancement indicated by the control parameter for the segment. Thus, the receiver performs parametric-coded enhancement on each segment for which the control parameter is a parametric-coded enhancement control parameter, and waveform-coded enhancement on each segment for which the control parameter is a waveform-coded enhancement control parameter.

If one is willing to incur the cost of transmitting (with each segment of an original audio mix) both waveform data (for implementing waveform-coded speech enhancement) and parametric-coded enhancement parameters with an original (unenhanced) mix, a higher degree of speech enhancement can be achieved by applying both waveform-coded enhancement and parametric-coded enhancement to individual segments of the mix. Thus, in a class of embodiments, the inventive method implements "blind" temporal SNR-based blending between parametric-coded enhancement and waveform-coded enhancement of segments of an audio program. In this context also, "blind" denotes that the switching is not perceptually guided by a complex auditory masking model (e.g., of a type to be described herein), but is guided by a sequence of SNR values corresponding to segments of the program.

Embodiments that implement "blind" temporal SNR-based blending typically include steps of: segmenting the unenhanced audio signal (original audio mix) into consecutive time slices (segments), and determining for each segment the SNR between the speech content and the other audio content (or between the speech content and total audio content) of the segment; determining (e.g., receiving a request for) a total amount ("T") of speech enhancement; and for each segment, providing a blend control parameter, where the value of the blend control parameter is determined by (is a function of) the SNR for the segment.

Figure 3:
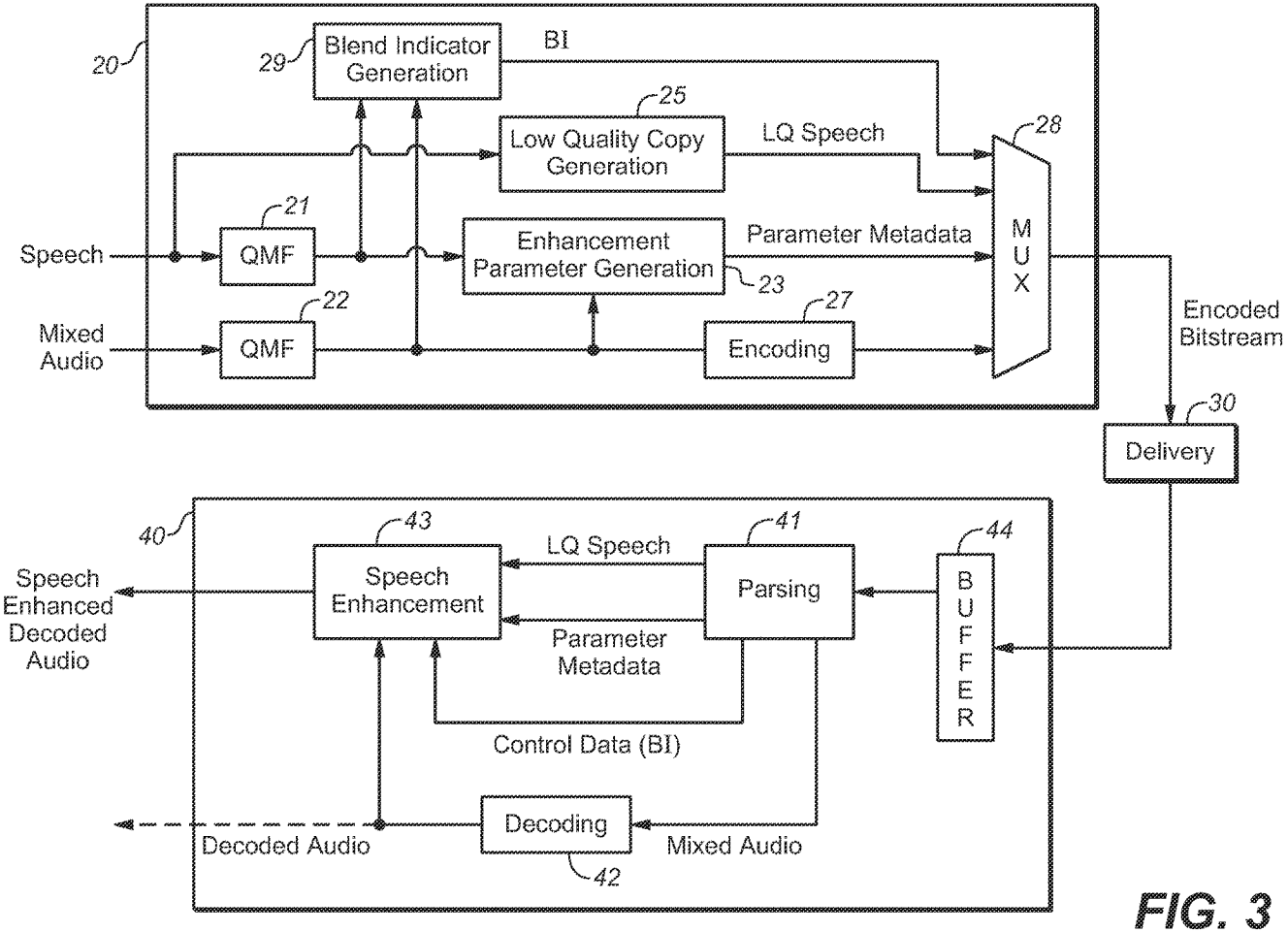
FIG. 3 is a block diagram of a system including an encoder configured to perform an embodiment of the inventive encoding method to generate an encoded audio bitstream indicative of an audio program, and a decoder configured to decode and perform speech enhancement (in accordance with an embodiment of the inventive method) on the encoded audio bitstream.

For example, the blend indicator for a segment of an audio program may be a blend indicator parameter (or parameter set) generated in subsystem 29 of the encoder of FIG. 3 for the segment.

The blend control indicator may be a parameter, $\alpha$, for each segment such that $T=\alpha Pw+(1-\alpha)Pp$, where Pw is the waveform-coded enhancement for the segment that would produce the predetermined total amount of enhancement, T, if applied to unenhanced audio content of the segment using waveform data provided for the segment (where the speech content of the segment has an unenhanced waveform, the waveform data for the segment are indicative of a reduced quality version of the speech content of the segment, the reduced quality version has a waveform similar (e.g., at least substantially similar) to the unenhanced waveform, and the reduced quality version of the speech content is of objectionable quality when rendered and perceived in isolation), and Pp is the parametric-coded enhancement that would produce the predetermined total amount of enhancement, T, if applied to unenhanced audio content of the segment using parametric data provided for the segment (where the parametric data for the segment, with the unenhanced audio content of the segment, determine a parametrically reconstructed version of the segment's speech content).

When the unenhanced audio signal is delivered (e.g., transmitted) with the control parameters as metadata to a receiver, the receiver may perform (on each segment) the hybrid speech enhancement indicated by the control parameters for the segment. Alternatively, the receiver generates the control parameters from the unenhanced audio signal.

In some embodiments, the receiver performs (on each segment of the unenhanced audio signal) a combination of parametric-coded enhancement Pp (scaled by the parameter $\alpha$ for the segment) and waveform-coded enhancement Pw (scaled by the value $(1-\alpha)$ for the segment), such that the combination of scaled parametric-coded enhancement and scaled waveform-coded enhancement generates the predetermined total amount of enhancement, as in expression (1) ($T=\alpha Pw+(1-\alpha)Pp$).

An example of the relation between $\alpha$ and SNR for a segment is as follows: $\alpha$ is a non-decreasing function of SNR, the range of $\alpha$ is 0 through 1, $\alpha$ has the value 0 when the SNR for the segment is less than or equal to a threshold value ("SNR_poor"), and $\alpha$ has the value 1 when the SNR is greater than or equal to a greater threshold value ("SNR_high"). When the SNR is favorable, $\alpha$ is high, resulting in a large proportion of parametric-coded enhancement. When the SNR is poor, $\alpha$ is low, resulting in a large proportion of waveform-coded enhancement. The location of the saturation points (SNR_poor and SNR_high) should be selected to accommodate the specific implementations of both the waveform-coded and parametric-coded enhancement algorithms.

In another class of embodiments, the combination of waveform-coded and parametric-coded enhancement to be performed on each segment of an audio signal is determined by an auditory masking model. In some embodiments in this class, the optimal blending ratio for a blend of waveform-coded and parametric-coded enhancement to be performed on a segment of an audio program uses the highest amount of waveform-coded enhancement that just keeps the coding noise from becoming audible.

In the above-described blind SNR-based blending embodiments, the blending ratio for a segment is derived from the SNR, and the SNR is assumed to be indicative of the capacity of the audio mix to mask the coding noise in the reduced quality version (copy) of speech to be employed for waveform-coded enhancement. Advantages of the blind SNR-based approach are simplicity in implementation and low computational load at the encoder. However, SNR is an unreliable predictor of how well coding noise will be masked and a large safety margin must be applied to ensure that coding noise will remain masked at all times. This means that at least some of the time the level of the reduced quality speech copy that is blended is lower than it could be, or, if the margin is set more aggressively, the coding noise becomes audible some of the time. The contribution of waveform-coded enhancement in the inventive hybrid coding scheme can be increased while ensuring that the coding noise does not become audible by using an auditory masking model to predict more accurately how the coding noise in the reduced quality speech copy is being masked by the audio mix of the main program and to select the blending ratio accordingly.

Typical embodiments which employ an auditory masking model include steps of: segmenting the unenhanced audio signal (original audio mix) into consecutive time slices (segments), and providing a reduced quality copy of the speech in each segment (for use in waveform-coded enhancement) and parametric-coded enhancement parameters (for use in parametric-coded enhancement) for each segment; for each of the segments, using the auditory masking model to determine a maximum amount of waveform-coded enhancement that can be applied without artifacts becoming audible; and generating a blend indicator (for each segment of the unenhanced audio signal) of a combination of waveform-coded enhancement (in an amount which does not exceed the maximum amount of waveform-coded enhancement determined using the auditory masking model for the segment, and which preferably at least substantially matches the maximum amount of waveform-coded enhancement determined using the auditory masking model for the segment) and parametric-coded enhancement, such that the combination of waveform-coded enhancement and parametric-coded enhancement generates a predetermined total amount of speech enhancement for the segment.

In some embodiments, each such blend indicator is included (e.g., by an encoder) in a bitstream which also includes encoded audio data indicative of the unenhanced audio signal. For example, subsystem 29 of encoder 20 of FIG. 3 may be configured to generate such blend indicators, and subsystem 28 of encoder 20 may be configured to include the blend indicators in the bitstream to be output from encoder 20. For another example, blend indicators may be generated (e.g., in subsystem 13 of the encoder of FIG. 7) from the $g_{max}(t)$ parameters generated by subsystem 14 of the FIG. 7 encoder, and subsystem 13 of the FIG. 7 encoder may be configured to include the blend indicators in the bitstream to be output from the FIG. 7 encoder (or subsystem 13 may include, in the bitstream to be output from the FIG. 7 encoder, the $g_{max}(t)$ parameters generated by subsystem 14, and a receiver which receives and parses the bitstream may be configured to generate the blend indicators in response to the $g_{max}(t)$ parameters).

Optionally, the method also includes a step of performing (on each segment of the unenhanced audio signal) in response to the blend indicator for each segment, the combination of waveform-coded enhancement and parametric-coded enhancement determined by the blend indicator, such that the combination of waveform-coded enhancement and parametric-coded enhancement generates the predetermined total amount of speech enhancement for the segment.

An example of an embodiment of the inventive method which employs an auditory masking model will be described with reference to FIG. 7. In this example, a mix of speech and background audio, A(t) (the unenhanced audio mix), is determined (in element 10 of FIG. 7) and passed to the auditory masking model (implemented by element 11 of FIG. 7) which predicts a masking threshold $\Theta(f,t)$ for each segment of the unenhanced audio mix. The unenhanced audio mix A(t) is also provided to encoding element 13 for encoding for transmission.

The masking threshold generated by the model indicates as a function of frequency and time the auditory excitation that any signal must exceed in order to be audible. Such masking models are well known in the art. The speech component, s(t), of each segment of the unenhanced audio mix, A(t), is encoded (in low-bitrate audio coder 15) to generate a reduced quality copy, s'(t), of the speech content of the segment. The reduced quality copy, s'(t) (which comprises fewer bits than the original speech, s(t)), can be conceptualized as the sum of the original speech, s(t), and coding noise, n(t). That coding noise can be separated from the reduced quality copy for analysis through subtraction (in element 16) of the time-aligned speech signal, s(t), from the reduced quality copy. Alternatively, the coding noise may be available directly from the audio coder.

The coding noise, n, is multiplied in element 17 by a scale factor, g(t), and the scaled coding noise is passed to an auditory model (implemented by element 18) which predicts the auditory excitation, N(f,t), generated by the scaled coding noise. Such excitation models are known in the art. In a final step, the auditory excitation N(f,t) is compared to the predicted masking threshold $\Theta(f,t)$ and the largest scale factor, $g_{max}(t)$, which ensures that the coding noise is masked, i.e., the largest value of g(t) which ensures that $N(f,t)<\Theta(f,t)$, is found (in element 14). If the auditory model is non-linear this may need to be done iteratively (as indicated in FIG. 2) by iterating the value of g(t) applied to the coding noise, n(t) in element 17; if the auditory model is linear this may be done in a simple feed forward step. The resulting scale factor $g_{max}(t)$ is the largest scale factor that can be applied to the reduced quality speech copy, s'(t), before it is added to the corresponding segment of the unenhanced audio mix, A(t), without the coding artifacts in the scaled, reduced quality speech copy becoming audible in the mix of the scaled, reduced quality speech copy, $g_{max}(t)$ *s'(t), and the unenhanced audio mix, A(t).

Figure 7:
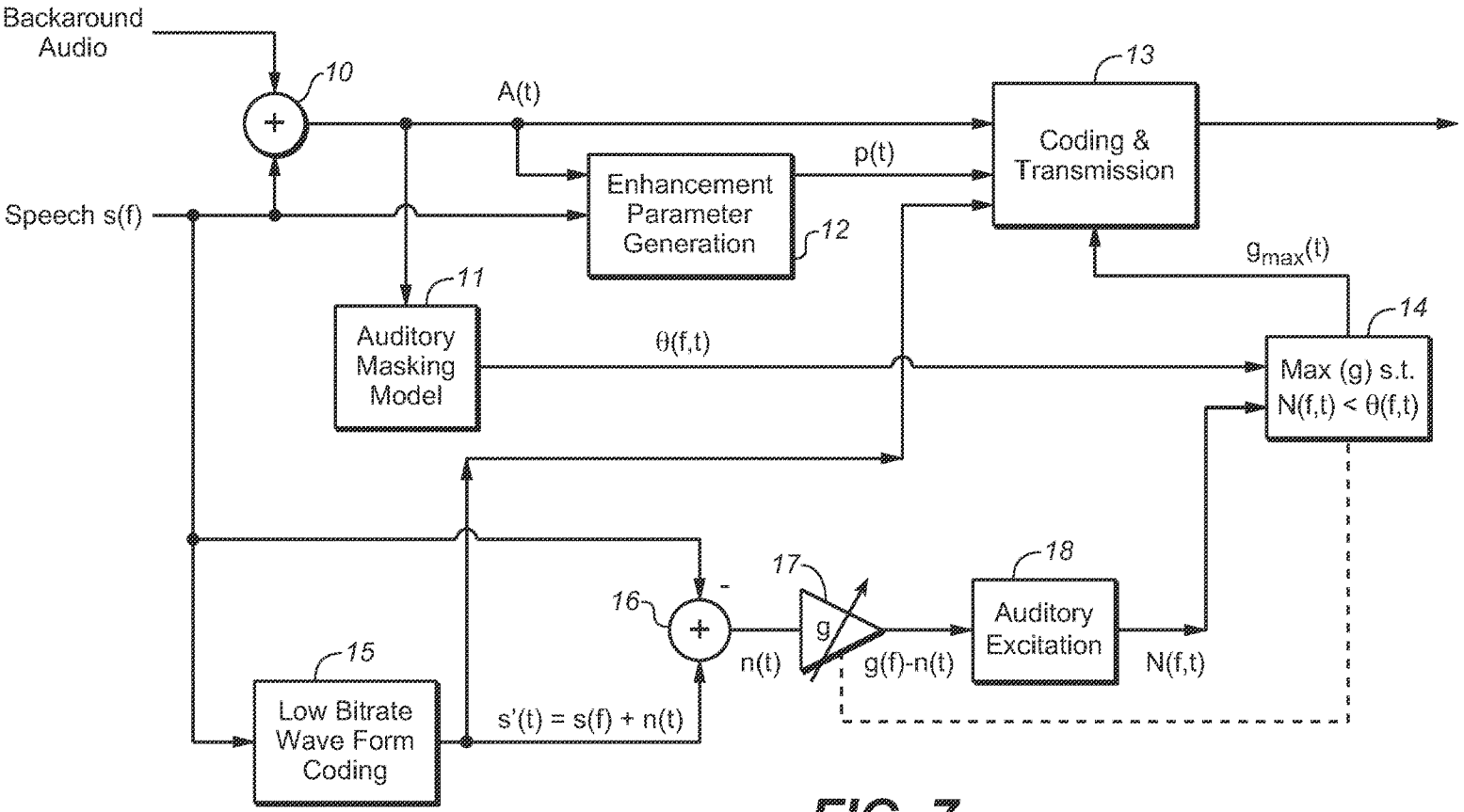
FIG. 7 is a block diagram of a system for performing and embodiment of the inventive encoding method using an auditory masking model.

The FIG. 7 system also includes element 12, which is configured to generate (in response to the unenhanced audio mix, A(t) and the speech, s(t)) parametric-coded enhancement parameters, p(t), for performing parametric-coded speech enhancement on each segment of the unenhanced audio mix.

The parametric-coded enhancement parameters, p(t), as well as the reduced quality speech copy, s'(t), generated in coder 15, and the factor, $g_{max}(t)$, generated in element 14, for each segment of the audio program, are also asserted to encoding element 13. Element 13 generates an encoded audio bitstream indicative of the unenhanced audio mix, A(t), parametric-coded enhancement parameters, p(t), reduced quality speech copy, s'(t), and the factor, $g_{max}(t)$, for each segment of the audio program, and this encoded audio bitstream may be transmitted or otherwise delivered to a receiver.

In the example, speech enhancement is performed (e.g., in a receiver to which the encoded output of element 13 has been delivered) as follows on each segment of the unenhanced audio mix, A(t), to apply a predetermined (e.g., requested) total amount of enhancement, T, using the scale factor $g_{max}(t)$ for the segment. The encoded audio program is decoded to extract the unenhanced audio mix, A(t), the parametric-coded enhancement parameters, p(t), the reduced quality speech copy, s'(t), and the factor $g_{max}(t)$ for each segment of the audio program. For each segment, waveform-coded enhancement, Pw, is determined to be the waveform-coded enhancement that would produce the predetermined total amount of enhancement, T, if applied to unenhanced audio content of the segment using the reduced quality speech copy, s'(t), for the segment, and parametric-coded enhancement, Pp, is determined to be the parametric-coded enhancement that would produce the predetermined total amount of enhancement, T, if applied to unenhanced audio content of the segment using parametric data provided for the segment (where the parametric data for the segment, with the unenhanced audio content of the segment, determine a parametrically reconstructed version of the segment's speech content). For each segment, a combination of parametric-coded enhancement (in an amount scaled by a parameter $\alpha_2$ for the segment) and waveform-coded enhancement (in an amount determined by the value $\alpha_1$ for the segment) is performed, such that the combination of parametric-coded enhancement and waveform-coded enhancement generates the predetermined total amount of enhancement using the largest amount of waveform-coded enhancement permitted by the model: $T=(\alpha_1(Pw)+\alpha_2(Pp))$, where, factor $\alpha_1$ is the maximum value which does not exceed $g_{max}(t)$ for the segment and allows attainment of the indicated equality ($T=(\alpha_1(Pw)+\alpha_2(Pp))$, and parameter $\alpha_2$ is the minimum non-negative value which allows attainment of the indicated equality ($T=(\alpha_1(Pw)+\alpha_2(Pp))$).

In an alternative embodiment, the artifacts of the parametric-coded enhancement are included in the assessment (performed by the auditory masking model) so as to allow the coding artifacts (due to waveform-coded enhancement) to become audible when this is favorable over the artifacts of the parametric-coded enhancement.

In variations on the FIG. 7 embodiment (and embodiments similar to that of FIG. 7 which employ an auditory masking model), sometimes referred to as auditory-model guided multi-band splitting embodiments, the relation between waveform-coded enhancement coding noise, N(f,t), in the reduced quality speech copy and the masking threshold $\Theta(f,t)$ may not be uniform across all frequency bands. For example, the spectral characteristics of the waveform-coded enhancement coding noise may be such that in a first frequency region the masking noise is about to exceed the masking threshold while in a second frequency region the masking noise is well below the masked threshold. In the FIG. 7 embodiment, the maximal contribution of waveform-coded enhancement would be determined by the coding noise in the first frequency region and the maximal scaling factor, g, that can be applied to the reduced quality speech copy is determined by the coding noise and masking properties in the first frequency region. It is smaller than the maximum scaling factor, g, that could be applied if determination of the maximum scaling factor were based only on the second frequency region. Overall performance could be improved if the principles of temporal blending were applied separately in the two frequency regions.

In one implementation of auditory-model guided multi-band splitting, the unenhanced audio signal is divided into M contiguous, non-overlapping frequency bands and the principles of temporal blending (i.e., hybrid speech enhancement with a blend of waveform-coded and parametric-coded enhancement, in accordance with an embodiment of the invention) are applied independently in each of the M bands. An alternative implementation partitions the spectrum into a low band below a cutoff frequency, fc, and a high band above the cutoff frequency, fc. The low band is always enhanced with waveform-coded enhancement and the upper band is always enhanced with parametric-coded enhancement. The cutoff frequency is varied over time and always selected to be as high as possible under the constraint that the waveform-coded enhancement coding noise at a predetermined total amount of speech enhancement, T, is below the masking threshold. In other words, the maximum cutoff frequency at any time is:

$$\max(fc|T*N(f<fc,t)<\Theta(f,t)) \quad (8)$$

The embodiments described above have assumed that the means available to keep waveform-coded enhancement coding artifacts from becoming audible is to adjust the blending ratio (of waveform-coded to parametric-coded enhancement) or to scale back the total amount of enhancement. An alternative is to control the amount of waveform-coded enhancement coding noise through a variable allocation of bitrate to generate the reduced quality speech copy. In an example of this alternative embodiment, a constant base amount of parametric-coded enhancement is applied, and additional waveform-coded enhancement is applied to reach the desired (predetermined) amount of total enhancement. The reduced quality speech copy is coded with a variable bitrate, and this bitrate is selected as the lowest bitrate that keeps waveform-coded enhancement coding noise below the masked threshold of parametric-coded enhanced main audio.

In some embodiments, the audio program whose speech content is to be enhanced in accordance with the invention includes speaker channels but not any object channel. In other embodiments, the audio program whose speech content is to be enhanced in accordance with the invention is an object based audio program (typically a multichannel object based audio program) comprising at least one object channel and optionally also at least one speaker channel.

Other aspects of the invention include an encoder configured to perform any embodiment of the inventive encoding method to generate an encoded audio signal in response to an audio input signal (e.g., in response to audio data indicative of a multichannel audio input signal), a decoder configured to decode such an encoded signal and perform speech enhancement on the decoded audio content, and a system including such an encoder and such a decoder. The FIG. 3 system is an example of such a system.

The system of FIG. 3 includes encoder 20, which is configured (e.g., programmed) to perform an embodiment of the inventive encoding method to generate an encoded audio signal in response to audio data indicative of an audio program. Typically, the program is a multichannel audio program. In some embodiments, the multichannel audio program comprises only speaker channels. In other embodiments, the multichannel audio program is an object based audio program comprising at least one object channel and optionally also at least one speaker channel.

The audio data include data (identified as "mixed audio" data in FIG. 3) indicative of mixed audio content (a mix of speech and non-speech content) and data (identified as "speech" data in FIG. 3) indicative of the speech content of the mixed audio content.

The speech data undergo a time domain-to-frequency (QMF) domain transform in stage 21, and the resulting QMF components are asserted to enhancement parameter generation element 23. The mixed audio data undergo a time domain-to-frequency (QMF) domain transform in stage 22, and the resulting QMF components are asserted to element 23 and to encoding subsystem 27.

The speech data are also asserted to subsystem 25 which is configured to generate waveform data (sometimes referred to herein as a "reduced quality" or "low quality" speech copy) indicative of a low quality copy of the speech data, for use in waveform-coded speech enhancement of the mixed (speech and non-speech) content determined by the mixed audio data. The low quality speech copy comprises fewer bits than does the original speech data, is of objectionable quality when rendered and perceived in isolation, and when rendered is indicative of speech having a waveform similar (e.g., at least substantially similar) to the waveform of the speech indicated by the original speech data. Methods of implementing subsystem 25 are known in the art. Examples are code excited linear prediction (CELP) speech coders such as AMR and G729.1 or modern mixed coders such as MPEG Unified Speech and Audio Coding (USAC), typically operated at a low bitrate (e.g., 20 kbps). Alternatively, frequency domain coders may be used, examples include Siren (G722.1), MPEG 2 Layer II/III, MPEG AAC.

Hybrid speech enhancement performed (e.g., in subsystem 43 of decoder 40) in accordance with typical embodiments of the invention includes a step of performing (on the waveform data) the inverse of the encoding performed (e.g., in subsystem 25 of encoder 20) to generate the waveform data, to recover a low quality copy of the speech content of the mixed audio signal to be enhanced. The recovered low quality copy of the speech is then used (with parametric data, and data indicative of the mixed audio signal) to perform remaining steps of the speech enhancement.

Element 23 is configured to generate parametric data in response to data output from stages 21 and 22. The parametric data, with the original mixed audio data, determines parametrically constructed speech which is a parametrically reconstructed version of the speech indicated by the original speech data (i.e., the speech content of the mixed audio data). The parametrically reconstructed version of the speech at least substantially matches (e.g., is a good approximation of) the speech indicated by the original speech data. The parametric data determine a set of parametric-coded enhancement parameters, p(t), for performing parametric-coded speech enhancement on each segment of the unenhanced mixed content determined by the mixed audio data.

Blend indicator generation element 29 is configured to generate a blend indicator ("BI") in response to the data output from stages 21 and 22. It is contemplated that the audio program indicated by the bitstream output from encoder 20 will undergo hybrid speech enhancement (e.g., in decoder 40) to determine a speech-enhanced audio program, including by combining the unenhanced audio data of the original program with a combination of low quality speech data (determined from the waveform data), and the parametric data. The blend indicator determines such combination (e.g., the combination has a sequence of states determined by a sequence of current values of the blend indicator), so that the speech-enhanced audio program has less audible speech enhancement coding artifacts (e.g., speech enhancement coding artifacts which are better masked) than would either a purely waveform-coded speech-enhanced audio program determined by combining only the low quality speech data with the unenhanced audio data or a purely parametric-coded speech-enhanced audio program determined by combining only the parametrically constructed speech with the unenhanced audio data.

In variations on the FIG. 3 embodiment, the blend indicator employed for the inventive hybrid speech enhancement is not generated in the inventive encoder (and is not included in the bitstream output from the encoder), but is instead generated (e.g., in a variation on receiver 40) in response to the bitstream output from the encoder (which bitstream does includes waveform data and parametric data).

It should be understood that the expression "blend indicator" is not intended to denote a single parameter or value (or a sequence of single parameters or values) for each segment of the bitstream. Rather, it is contemplated that in some embodiments, a blend indicator (for a segment of the bitstream) may be a set of two or more parameters or values (e.g., for each segment, a parametric-coded enhancement control parameter, and a waveform-coded enhancement control parameter).

Encoding subsystem 27 generates encoded audio data indicative of the audio content of the mixed audio data (typically, a compressed version of the mixed audio data). Encoding subsystem 27 typically implements an inverse of the transform performed in stage 22 as well as other encoding operations.

Formatting stage 28 is configured to assemble the parametric data output from element 23, the waveform data output from element 25, the blend indicator generated in element 29, and the encoded audio data output from subsystem 27 into an encoded bitstream indicative of the audio program. The bitstream (which may have E-AC-3 or AC-3 format, in some implementations) includes the unencoded parametric data, waveform data, and blend indicator.

The encoded audio bitstream (an encoded audio signal) output from encoder 20 is provided to delivery subsystem 30. Delivery subsystem 30 is configured to store the encoded audio signal (e.g., to store data indicative of the encoded audio signal) generated by encoder 20 and/or to transmit the encoded audio signal.

Decoder 40 is coupled and configured (e.g., programmed) to receive the encoded audio signal from subsystem 30 (e.g., by reading or retrieving data indicative of the encoded audio signal from storage in subsystem 30, or receiving the encoded audio signal that has been transmitted by subsystem 30), and to decode data indicative of mixed (speech and non-speech) audio content of the encoded audio signal, and to perform hybrid speech enhancement on the decoded mixed audio content. Decoder 40 is typically configured to generate and output (e.g., to a rendering system, not shown in FIG. 3) a speech-enhanced, decoded audio signal indicative of a speech-enhanced version of the mixed audio content input to encoder 20. Alternatively, it includes such a rendering system which is coupled to receive the output of subsystem 43.

Buffer 44 (a buffer memory) of decoder 40 stores (e.g., in a non-transitory manner) at least one segment (e.g., frame) of the encoded audio signal (bitstream) received by decoder 40. In typical operation, a sequence of the segments of the encoded audio bitstream is provided to buffer 44 and asserted from buffer 44 to deformatting stage 41.

Deformatting (parsing) stage 41 of decoder 40 is configured to parse the encoded bitstream from delivery subsystem 30, to extract therefrom the parametric data (generated by element 23 of encoder 20), the waveform data (generated by element 25 of encoder 20), the blend indicator (generated in element 29 of encoder 20), and the encoded mixed (speech and non-speech) audio data (generated in encoding subsystem 27 of encoder 20).

The encoded mixed audio data is decoded in decoding subsystem 42 of decoder 40, and the resulting decoded, mixed (speech and non-speech) audio data is asserted to hybrid speech enhancement subsystem 43 (and is optionally output from decoder 40 without undergoing speech enhancement).

In response to control data (including the blend indicator) extracted by stage 41 from the bitstream (or generated in stage 41 in response to metadata included in the bitstream), and in response to the parametric data and the waveform data extracted by stage 41, speech enhancement subsystem 43 performs hybrid speech enhancement on the decoded mixed (speech and non-speech) audio data from decoding subsystem 42 in accordance with an embodiment of the invention. The speech-enhanced audio signal output from subsystem 43 is indicative of a speech-enhanced version of the mixed audio content input to encoder 20.

In various implementations of encoder 20 of FIG. 3, subsystem 23 may generate any of the described examples of prediction parameters, $p_i$, for each tile of each channel of the mixed audio input signal, for use (e.g., in decoder 40) for reconstruction of the speech component of a decoded mixed audio signal.

With a speech signal indicative of the speech content of the decoded mixed audio signal (e.g., the low quality copy of the speech generated by subsystem 25 of encoder 20, or a reconstruction of the speech content generated using prediction parameters, $p_i$, generated by subsystem 23 of encoder 20), speech enhancement can be performed (e.g., in subsystem of 43 of decoder 40 of FIG. 3) by mixing of the speech signal with the decoded mixed audio signal. By applying a gain to the speech to be added (mixed in), it is possible to control the amount of speech enhancement. For a 6 dB enhancement, the speech may be added with a 0 dB gain (provided that the speech in the speech-enhanced mix has the same level as the transmitted or reconstructed speech signal). The speech-enhanced signal is:

$$M_e = M + g \cdot D_r \tag{9}$$

In some embodiments, to achieve a speech enhancement gain, G, the following mixing gain is applied:

$$g = 10^{G/20} - 1 \tag{10}$$

In the case of channel independent speech reconstruction, the speech enhanced mix, $M_e$, is obtained as:

$$M_e = M \cdot (1 + \mathrm{diag}(P) \cdot g) \tag{11}$$

In the above-described example, the speech contribution in each channel of the mixed audio signal is reconstructed with the same energy. When the speech has been transmitted as a side signal (e.g., as a low quality copy of the speech content of a mixed audio signal) or when the speech is reconstructed using multiple channels (such as with an MMSE predictor), the speech enhancement mixing requires speech rendering information in order to mix the speech with the same distribution over the different channels as the speech component already present in the mixed audio signal to be enhanced.

This rendering information may be provided by a rendering parameter $r_i$ for each channel, which can be represented as a rendering vector R which has form $$R = \begin{pmatrix} r_1 \\ r_2 \\ r_3 \end{pmatrix} \tag{12}$$

when there are three channels. The speech enhancement mixing is:

$$M_e = M + R \cdot g \cdot D_r \tag{13}$$

In the case that there are multiple channels, and the speech (to be mixed with each channel of a mixed audio signal) is reconstructed using prediction parameters $p_i$, the previous equation can be written as:

$$M_e = M + R \cdot g \cdot P \cdot M = (I + R \cdot g \cdot P) \cdot M \tag{14}$$

where I is the identity matrix.

5. Speech Rendering

Figure 4:
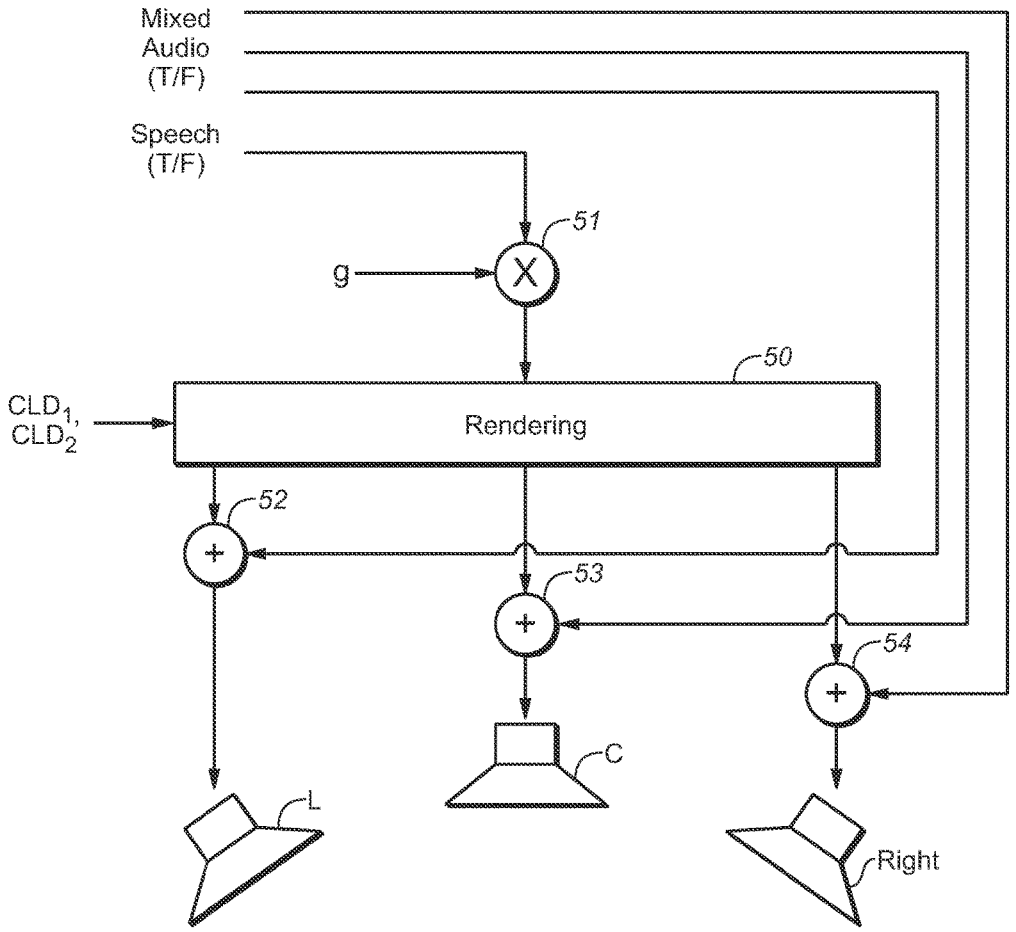
FIG. 4 is a block diagram of a system configured to render a multi-channel mixed content audio signal, including by performing conventional speech enhancement thereon.

FIG. 4 is a block diagram of a speech rendering system which implements conventional speech enhancement mixing of form:

$$M_e = M + R \cdot g \cdot D_r \tag{15}$$

In FIG. 4, the three-channel mixed audio signal to be enhanced is in (or is transformed into) the frequency domain. The frequency components of left channel are asserted to an input of mixing element 52, the frequency components of center channel are asserted to an input of mixing element 53, and the frequency components of right channel are asserted to an input of mixing element 54.

The speech signal to be mixed with the mixed audio signal (to enhance the latter signal) may have been transmitted as a side signal (e.g., as a low quality copy of the speech content of the mixed audio signal) or may have been reconstructed from prediction parameters, $p_i$, transmitted with the mixed audio signal. The speech signal is indicated by frequency domain data (e.g., it comprises frequency components generated by transforming a time domain signal into the frequency domain), and these frequency components are asserted to an input of mixing element 51, in which they are multiplied by the gain parameter, g.

The output of element 51 is asserted to rendering subsystem 50. Also asserted to rendering subsystem 50 are CLD (channel level difference) parameters, $CLD_1$ and $CLD_2$, which have been transmitted with the mixed audio signal. The CLD parameters (for each segment of the mixed audio signal) describe how the speech signal is mixed to the channels of said segment of the mixed audio signal content. $CLD_1$ indicates a panning coefficient for one pair of speaker channels (e.g., which defines panning of the speech between the left and center channels), and $CLD_2$ indicates a panning coefficient for another pair of the speaker channels (e.g., which defines panning of the speech between the center and right channels). Thus, rendering subsystem 50 asserts (to element 52) data indicative of $R \cdot g \cdot D_r$ for the left channel (the speech content, scaled by the gain parameter and the rendering parameter for the left channel), and this data is summed with the left channel of the mixed audio signal in element 52. Rendering subsystem 50 asserts (to element 53) data indicative of $R \cdot g \cdot D_r$ for the center channel (the speech content, scaled by the gain parameter and the rendering parameter for the center channel), and this data is summed with the center channel of the mixed audio signal in element 53. Rendering subsystem 50 asserts (to element 54) data indicative of $R \cdot g \cdot D_r$ for the right channel (the speech content, scaled by the gain parameter and the rendering parameter for the right channel) and this data is summed with the right channel of the mixed audio signal in element 54.

The outputs of elements 52, 53, and 54 are employed, respectively, to drive left speaker L, center speaker C, and right speaker "Right."

Figure 5:
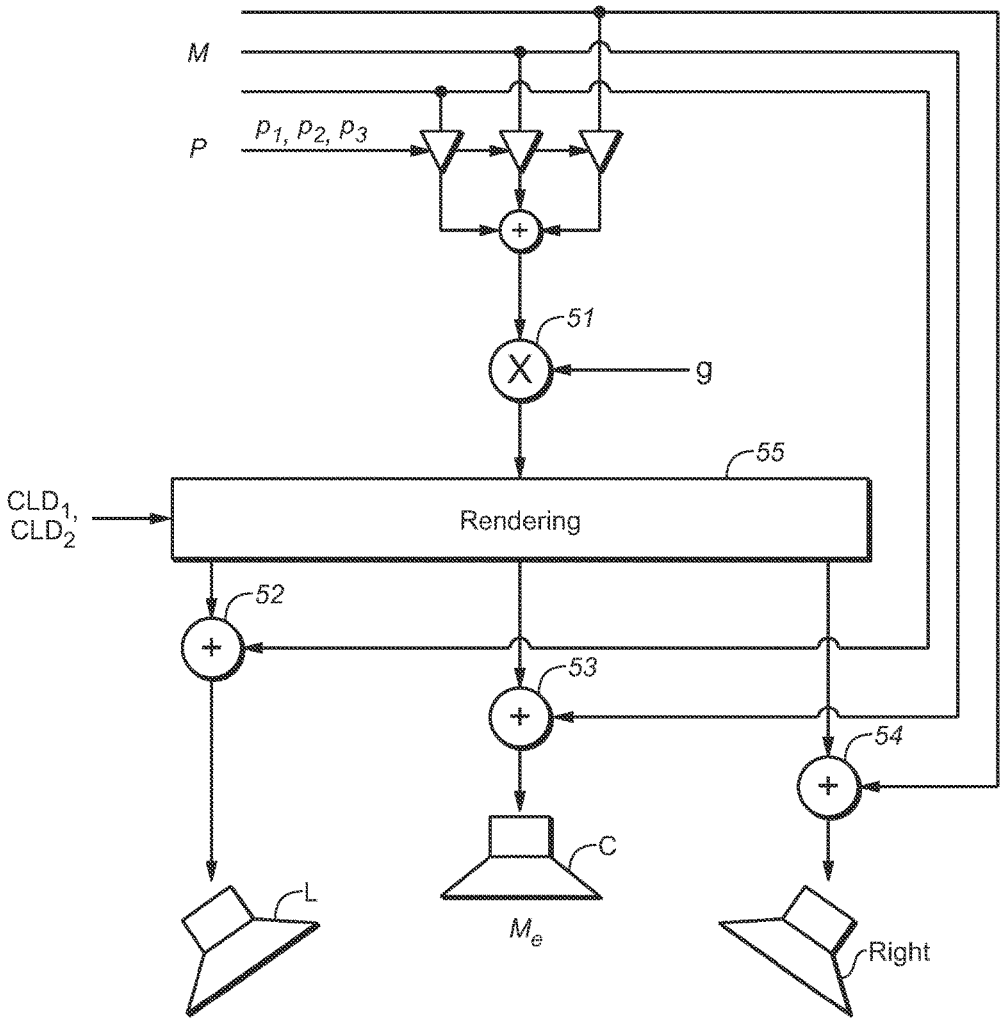
FIG. 5 is a block diagram of a system configured to render a multi-channel mixed content audio signal, including by performing conventional parametric-coded speech enhancement thereon.

FIG. 5 is a block diagram of a speech rendering system which implements conventional speech enhancement mixing of form:

$$M_e = M + R \cdot g \cdot P \cdot M = (I + R \cdot g \cdot P) \cdot M \tag{16}$$

In FIG. 5, the three-channel mixed audio signal to be enhanced is in (or is transformed into) the frequency domain. The frequency components of left channel are asserted to an input of mixing element 52, the frequency components of center channel are asserted to an input of mixing element 53, and the frequency components of right channel are asserted to an input of mixing element 54.

The speech signal to be mixed with the mixed audio signal is reconstructed (as indicated) from prediction parameters, $p_i$, transmitted with the mixed audio signal. Prediction parameter $p_1$ is employed to reconstruct speech from the first (left) channel of the mixed audio signal, prediction parameter $p_2$ is employed to reconstruct speech from the second (center) channel of the mixed audio signal, and prediction parameter $p_3$ is employed to reconstruct speech from the third (right) channel of the mixed audio signal. The speech signal is indicated by frequency domain data, and these frequency components are asserted to an input of mixing element 51, in which they are multiplied by the gain parameter, g.

The output of element 51 is asserted to rendering subsystem 55. Also asserted to rendering subsystem are CLD (channel level difference) parameters, $CLD_1$ and $CLD_2$, which have been transmitted with the mixed audio signal. The CLD parameters (for each segment of the mixed audio signal) describe how the speech signal is mixed to the channels of said segment of the mixed audio signal content. $CLD_1$ indicates a panning coefficient for one pair of speaker channels (e.g., which defines panning of the speech between the left and center channels), and $CLD_2$ indicates a panning coefficient for another pair of the speaker channels (e.g., which defines panning of the speech between the center and right channels). Thus, rendering subsystem 55 asserts (to element 52) data indicative of $R \cdot g \cdot P \cdot M$ for the left channel (the reconstructed speech content mixed with the left channel of the mixed audio content, scaled by the gain parameter and the rendering parameter for the left channel, mixed with the left channel of the mixed audio content) and this data is summed with the left channel of the mixed audio signal in element 52. Rendering subsystem 55 asserts (to element 53) data indicative of $R \cdot g \cdot P \cdot M$ for the center channel (the reconstructed speech content mixed with the center channel of the mixed audio content, scaled by the gain parameter and the rendering parameter for the center channel), and this data is summed with the center channel of the mixed audio signal in element 53. Rendering subsystem 55 asserts (to element 54) data indicative of $R \cdot g \cdot P \cdot M$ for the right channel (the reconstructed speech content mixed with the right channel of the mixed audio content, scaled by the gain parameter and the rendering parameter for the right channel) and this data is summed with the right channel of the mixed audio signal in element 54.

The outputs of elements 52, 53, and 54 are employed, respectively, to drive left speaker L, center speaker C, and right speaker "Right."

CLD (channel level difference) parameters are conventionally transmitted with speaker channel signals (e.g., to determine ratios between the levels at which different channels should be rendered). They are used in a novel way in some embodiments of the invention (e.g., to pan enhanced speech, between speaker channels of a speech-enhanced audio program).

In typical embodiments, the rendering parameters $r_i$ are (or are indicative of) upmix coefficients of the speech, describing how the speech signal is mixed to the channels of the mixed audio signal to be enhanced. These coefficients may be efficiently transmitted to the speech enhancer using channel level difference parameters (CLDs). One CLD indicates panning coefficients for two speakers. For example, $$\beta_1 = \sqrt{\frac{1}{1 + 10^{\frac{CLD}{10}}}} \tag{17}$$

-continued $$\beta_2 = \sqrt{\frac{10^{\frac{CLD}{10}}}{1+10^{\frac{CLD}{10}}}} \tag{18}$$

where $\beta_1$ indicates gain for the speaker feed for first speaker and $\beta_2$ indicates gain for the speaker feed for the second speaker at an instant during the pan. With CLD=0, the panning is fully on the first speaker, whereas with CLD approaching infinity, the panning is fully towards the second speaker. With CLDs defined in the dB domain, a limited number of quantization levels may be sufficient to describe the panning.

With two CLDs, panning over three speakers can be defined. The CLDs can be derived as follows from the rendering coefficients:

$$CLD_1 = 10\cdot\log_{10}\left(\frac{\bar{r}_2^2}{\bar{r}_1^2}\right) \tag{19}$$

$$CLD_2 = 10\cdot\log_{10}\left(\frac{\bar{r}_3^2}{\bar{r}_1^2+\bar{r}_2^2}\right) \tag{20}$$

where $$\bar{r}_x^2 = \frac{r_x^2}{\sum_i r_i^2}$$

are the normalized rendering coefficients such that $$\bar{r}_1^2+\bar{r}_2^2+\bar{r}_3^2=1 \tag{21}$$

The rendering coefficients can then be reconstructed from the CLDs by:

$$R = \begin{pmatrix} r_1 \\ r_2 \\ r_3 \end{pmatrix} = \begin{pmatrix} \sqrt{\frac{1}{\left(1+10^{\frac{CLD_1}{10}}\right)\left(1+10^{\frac{CLD_2}{10}}\right)}} \\ \sqrt{\frac{10^{\frac{CLD_1}{10}}}{\left(1+10^{\frac{CLD_1}{10}}\right)\cdot\left(1+10^{\frac{CLD_2}{10}}\right)}} \\ \sqrt{\frac{10^{\frac{CLD_2}{10}}}{1+10^{\frac{CLD_2}{10}}}} \end{pmatrix} \tag{22}$$

As noted elsewhere herein, waveform-coded speech enhancement uses a low-quality copy of the speech content of the mixed content signal to be enhanced. The low-quality copy is typically coded at a low bitrate and transmitted as a side signal with the mixed content signal, and therefore the low-quality copy typically contains significant coding artifacts. Thus, waveform-coded speech enhancement provides a good speech enhancement performance in situations with a low SNR (i.e. low ratio between speech and all other sounds indicated by the mixed content signal), and typically provides poor performance (i.e., results in undesirable audible coding artifacts) in situations with high SNR.

Conversely, when the speech content (of a mixed content signal to be enhanced) is singled out (e.g., is provided as the only content of a center channel of a multi-channel, mixed content signal) or the mixed content signal otherwise has high SNR, parametric-coded speech enhancement provides a good speech enhancement performance.

Therefore, waveform-coded speech enhancement and parametric-coded speech enhancement have complementary performance. Based on the properties of the signal whose speech content is to be enhanced, a class of embodiments of the invention blends the two methods to leverage their performances.

Figure 6:
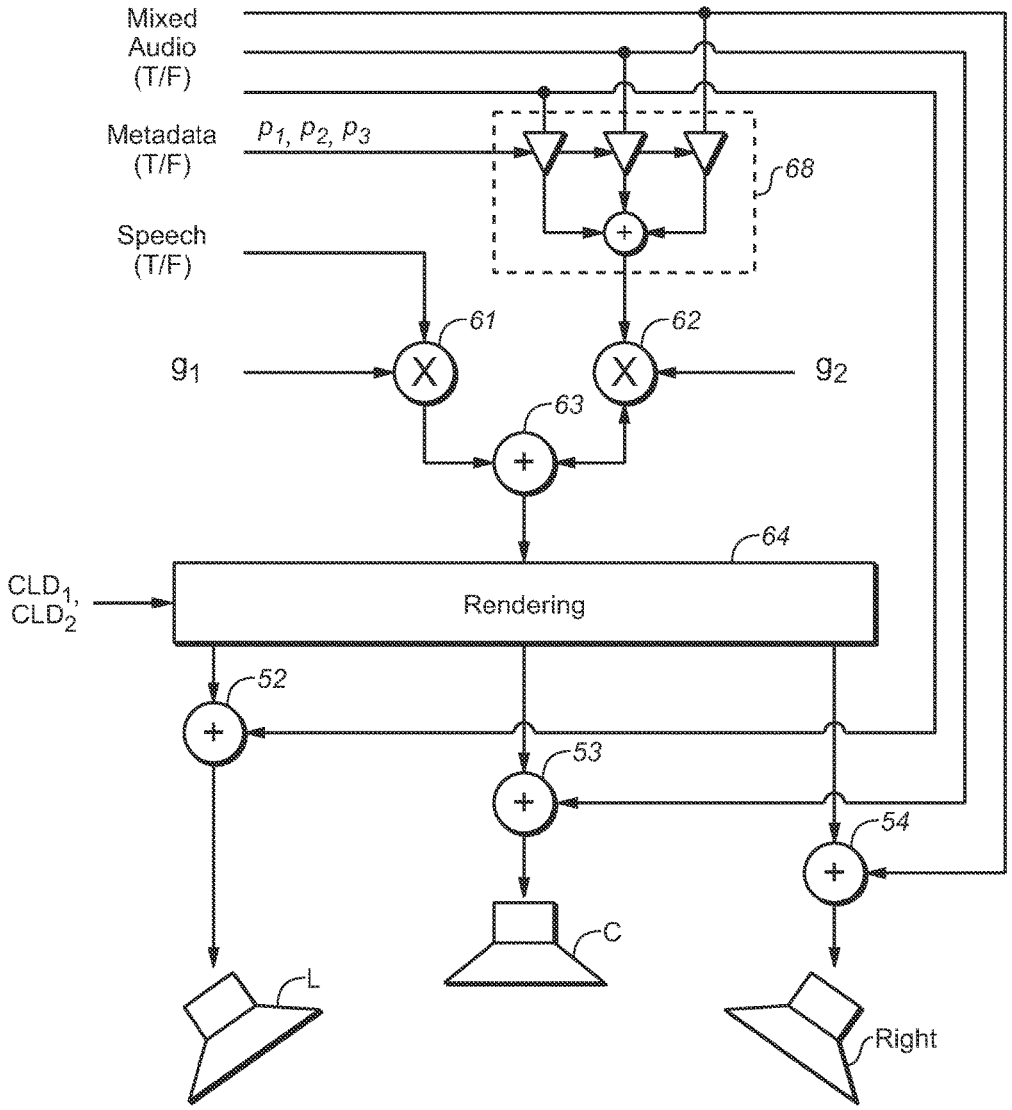
FIG. 6 and FIG. 6A are block diagrams of systems configured to render a multi-channel mixed content audio signal, including by performing an embodiment of the inventive speech enhancement method thereon.

FIG. 6 is a block diagram of a speech rendering system in this class of embodiments which is configured to perform hybrid speech enhancement. In one implementation, subsystem 43 of decoder 40 of FIG. 3 embodies the FIG. 6 system (except for the three speakers shown in FIG. 6). The hybrid speech enhancement (mixing) may be described by $$M_e=R\cdot g_1\cdot D_r+(I+R\cdot g_2\cdot P)\cdot M \tag{23}$$

where $R\cdot g_1\cdot D_r$ is waveform-coded speech enhancement of the type implemented by the conventional FIG. 4 system, $R\cdot g_2\cdot P\cdot M$ is parametric-coded speech enhancement of the type implemented by the conventional FIG. 5 system, and parameters $g_1$ and $g_2$ control the overall enhancement gain and the trade-off between the two speech enhancement methods. An example of a definition of the parameters $g_1$ and $g_2$ is:

$$g_1=\alpha_c\cdot(10^{G/20}-1) \tag{24}$$

$$g_2(1-\alpha_c)\cdot(10^{G/20}-1) \tag{25}$$

where the parameter $\alpha_c$ defines the trade-off between the parametric-coded speech enhancement and parametric-coded speech enhancement methods. With a value of $\alpha_c=1$, only the low-quality copy of speech is used for waveform-coded speech enhancement. The parametric-coded enhancement mode is contributing fully to the enhancement when $\alpha_c=0$. Values of $\alpha_c$ between 0 and 1 blend the two methods. In some implementations, $\alpha_c$ is a wideband parameter (applying to all frequency bands of the audio data). The same principles can be applied within individual frequency bands, such that the blending is optimized in a frequency dependent manner using a different value of the parameter $\alpha_c$ for each frequency band.

In FIG. 6, the three-channel mixed audio signal to be enhanced is in (or is transformed into) the frequency domain. The frequency components of left channel are asserted to an input of mixing element 65, the frequency components of center channel are asserted to an input of mixing element 66, and the frequency components of right channel are asserted to an input of mixing element 67.

The speech signal to be mixed with the mixed audio signal (to enhance the latter signal) includes a low quality copy (identified as "Speech" in FIG. 6) of the speech content of the mixed audio signal which has been generated from waveform data transmitted (in accordance with waveform-coded speech enhancement) with the mixed audio signal (e.g., as a side signal), and a reconstructed speech signal (output from parametric-coded speech reconstruction element 68 of FIG. 6) which is reconstructed from the mixed audio signal and prediction parameters, $p_i$, transmitted (in accordance with parametric-coded speech enhancement) with the mixed audio signal. The speech signal is indicated by frequency domain data (e.g., it comprises frequency components generated by transforming a time domain signal into the frequency domain). The frequency components of the low quality speech copy are asserted to an input of mixing element 61, in which they are multiplied by the gain parameter, $g_2$. The frequency components of the parametrically reconstructed speech signal are asserted from the output of element 68 to an input of mixing element 62, in which they are multiplied by the gain parameter, $g_1$. In alternative embodiments, the mixing performed to implement speech enhancement is performed in the time domain, rather than in the frequency domain as in the FIG. 6 embodiment.

The output of elements 61 and 62 are summed by summation element 63 to generate the speech signal to be mixed with the mixed audio signal, and this speech signal is asserted from the output of element 63 to rendering subsystem 64. Also asserted to rendering subsystem 64 are CLD (channel level difference) parameters, $CLD_1$ and $CLD_2$, which have been transmitted with the mixed audio signal. The CLD parameters (for each segment of the mixed audio signal) describe how the speech signal is mixed to the channels of said segment of the mixed audio signal content. $CLD_1$ indicates a panning coefficient for one pair of speaker channels (e.g., which defines panning of the speech between the left and center channels), and $CLD_2$ indicates a panning coefficient for another pair of the speaker channels (e.g., which defines panning of the speech between the center and right channels). Thus, rendering subsystem 64 asserts (to element 52) data indicative of $R \cdot g_1 \cdot D_r + (R \cdot g_2 \cdot P) \cdot M$ for the left channel (the reconstructed speech content mixed with the left channel of the mixed audio content, scaled by the gain parameter and the rendering parameter for the left channel, mixed with the left channel of the mixed audio content) and this data is summed with the left channel of the mixed audio signal in element 52. Rendering subsystem 64 asserts (to element 53) data indicative of $R \cdot g_1 \cdot D_r + (R \cdot g_2 \cdot P) \cdot M$ for the center channel (the reconstructed speech content mixed with the center channel of the mixed audio content, scaled by the gain parameter and the rendering parameter for the center channel), and this data is summed with the center channel of the mixed audio signal in element 53. Rendering subsystem 64 asserts (to element 54) data indicative of $R \cdot g_1 \cdot D_r + (R \cdot g_2 \cdot P) \cdot M$ for the right channel (the reconstructed speech content mixed with the right channel of the mixed audio content, scaled by the gain parameter and the rendering parameter for the right channel) and this data is summed with the right channel of the mixed audio signal in element 54.

The outputs of elements 52, 53, and 54 are employed, respectively, to drive left speaker L, center speaker C, and right speaker "Right."

The FIG. 6 system may implement temporal SNR-based switching when the parameter $\alpha_c$ is constrained to have either the value $\alpha_c=0$ or the value $\alpha_c=1$. Such an implementation is especially useful in strongly bitrate constrained situations in which either the low quality speech copy data can be sent or the parametric data can be sent, but not both. For example, in one such implementation, the low quality speech copy is transmitted with the mixed audio signal (e.g., as a side signal) only in segments for which $\alpha_c=1$, and the prediction parameters, $p_i$, are transmitted with the mixed audio signal (e.g., as a side signal) only in segments for which $\alpha_c=0$.

The switch (implemented by elements 61 and 62 of this implementation of FIG. 6) determines whether waveform-coded enhancement or parametric-coded enhancement is to be performed on each segment, based on the ratio (SNR) between speech and all the other audio content in the segment (this ratio in turn determines the value of $\alpha_c$). Such an implementation may use a threshold value of the SNR to decide which method to choose:

$$\alpha_c = \begin{cases} 0 & \text{if } SNR > \tau \\ 1 & \text{if } SNR \le \tau \end{cases} \tag{26}$$

where $\tau$ is a threshold value (e.g., $\tau$ may be equal to 0).

Some implementations of FIG. 6 employ hysteresis to prevent fast alternating switching between the waveform-coded enhancement and parametric-coded enhancement modes when the SNR is around the threshold value for several frames.

The FIG. 6 system may implement temporal SNR-based blending when the parameter $\alpha_c$ is allowed to have any real value in the range from 0 through 1, inclusive.

One implementation of the FIG. 6 system uses two target values, $\tau_1$ and $\tau_2$ (of the SNR of a segment of the mixed audio signal to be enhanced) beyond which one method (either waveform-coded enhancement or parametric-coded enhancement) is always considered to provide the best performance. Between these targets, interpolation is employed to determine the value of the parameter $\alpha_c$ for the segment. For example, linear interpolation may be employed to determine the value of parameter $\alpha_c$ for the segment:

$$\alpha_c = \begin{cases} 0 & \text{if } SNR > \tau_2 \\ 1 - \dfrac{SNR - \tau_1}{\tau_2 - \tau_1} & \text{if } \tau_1 < SNR \le \tau_2 \\ 1 & \text{if } SNR \le \tau_1 \end{cases} \tag{27}$$

Alternatively, other suitable interpolation schemes can be used. When the SNR is not available, the prediction parameters in many implementations may be used to provide an approximation of the SNR.

In another class of embodiments, the combination of waveform-coded and parametric-coded enhancement to be performed on each segment of an audio signal is determined by an auditory masking model. In typical embodiments in this class, the optimal blending ratio for a blend of waveform-coded and parametric-coded enhancement to be performed on a segment of an audio program uses the highest amount of waveform-coded enhancement that just keeps the coding noise from becoming audible. An example of an embodiment of the inventive method which employs an auditory masking model is described herein with reference to FIG. 7.

More generally, the following considerations pertain to embodiments in which an auditory masking model is used to determine a combination (e.g., blend) of waveform-coded and parametric-coded enhancement to be performed on each segment of an audio signal. In such embodiments, data indicative of a mix of speech and background audio, A(t), to be referred to as an unenhanced audio mix, is provided and processed in accordance with the auditory masking model (e.g., the model implemented by element 11 of FIG. 7). The model predicts a masking threshold $\Theta(f,t)$ for each segment of the unenhanced audio mix. The masking threshold of each time-frequency tile of the unenhanced audio mix, having temporal index n and frequency banding index b, may be denoted as $\Theta_{n,b}$.

The masking threshold $\Theta_{n,b}$ indicates for frame n and band b how much distortion may be added without being audible. Let $\varepsilon_{D,n,b}$ be the encoding error (i.e., quantization noise) of the low quality speech copy (to be employed for waveform-coded enhancement), and $\varepsilon_{P,n,b}$ be the parametric prediction error.

Some embodiments in this class implement a hard switch to the method (waveform-coded or parametric-coded enhancement) that is best masked by the unenhanced audio mix content:

$$\alpha_c = \begin{cases} 0 & \text{if } \sum_{n,b} \Theta_{n,b} - \varepsilon_{p,n,b} > \sum_{n,b} \Theta_{n,b} - \varepsilon_{D,n,b} \\ 1 & \text{if } \sum_{n,b} \Theta_{n,b} - \varepsilon_{p,n,b} \leq \sum_{n,b} \Theta_{n,b} - \varepsilon_{D,n,b} \end{cases} \tag{28}$$

In many practical situations, the exact parametric prediction error $\varepsilon_{P,n,b}$ may not be available at the moment of generating the speech enhancement parameters, since these may be generated before the unenhanced mixed mix is encoded. Especially parametric coding schemes can have a significant effect on the error of a parametric reconstruction of the speech from the mixed content channels.

Therefore, some alternative embodiments blend in parametric-coded speech enhancement (with waveform-coded enhancement) when the coding artifacts in the low quality speech copy (to be employed for waveform-coded enhancement) are not masked by the mixed content:

$$\alpha_c = \begin{cases} 1 & \text{if } \sum_{n,b} \Theta_{n,b} - \varepsilon_{D,n,b} \geq 0 \\ 1 - \dfrac{\sum_{n,b} \Theta_{n,b} - \varepsilon_{D,n,b}}{\tau_a} & \text{if } -\tau_a \leq \sum_{n,b} \Theta_{n,b} - \varepsilon_{D,n,b} < 0 \\ 0 & \text{if } \sum_{n,b} \Theta_{n,b} - \varepsilon_{D,n,b} < -\tau_a \end{cases} \tag{29}$$

in which $\tau_a$ is a distortion threshold beyond which only parametric-coded enhancement is applied. This solution starts blending of waveform-coded and parametric-coded enhancement when the overall distortion is larger than the overall masking potential. In practice this means that distortions were already audible. Therefore, a second threshold could be used with a higher value than 0. Alternatively, one could use conditions that rather focus on the unmasked time-frequency tiles instead of the average behavior.

Similarly, this approach can be combined with an SNR-guided blending rule when the distortions (coding artifacts) in the low quality speech copy (to be employed for waveform-coded enhancement) are too high. An advantage of this approach is that in cases of very low SNR the parametric-coded enhancement mode is not used as it produces more audible noise than the distortions of the low quality speech copy.

In another embodiment, the type of speech enhancement performed for some time-frequency tiles deviates from that determined by the example schemes described above (or similar schemes) when a spectral hole is detected in each such time-frequency tile. Spectral holes can be detected for example by evaluating the energy in the corresponding tile in the parametric reconstruction whereas the energy is 0 in the low quality speech copy (to be employed for waveform-coded enhancement). If this energy exceeds a threshold, it may be considered as relevant audio. In these cases the parameter $\alpha_c$ for the tile may be set to 0 (or, depending on the SNR the parameter $\alpha_c$ for the tile may be biased towards 0).

In some embodiments, the inventive encoder is operable in any selected one of the following modes:

1. Channel independent parametric—In this mode, a parameter set is transmitted for each channel that contains speech. Using these parameters, a decoder which receives the encoded audio program can perform parametric-coded speech enhancement on the program to boost the speech in these channels by an arbitrary amount. An example bitrate for transmission of the parameter set is 0.75-2.25 kbps.

2. Multichannel speech prediction—In this mode multiple channels of the mixed content are combined in a linear combination to predict the speech signal. A parameter set is transmitted for each channel. Using these parameters, a decoder which receives the encoded audio program can perform parametric-coded speech enhancement on the program. Additional positional data is transmitted with the encoded audio program to enable rendering of the boosted speech back into the mix. An example bitrate for transmission of the parameter set and positional data is 1.5-6.75 kbps per dialog.

3. Waveform coded speech—In this mode, a low quality copy of the speech content of the audio program is transmitted separately, by any suitable means, in parallel with the regular audio content (e.g., as a separate substream). A decoder which receives the encoded audio program can perform waveform-coded speech enhancement on the program by mixing in the separate low quality copy of the speech content with the main mix. Mixing the low quality copy of the speech with a gain of 0 dB will typically boost the speech by 6 dB, as the amplitude is doubled. For this mode also positional data is transmitted such that the speech signal is distributed correctly over the relevant channels. An example bitrate for transmission of the low quality copy of the speech and positional data is more than 20 kbps per dialog.

4. Waveform-parametric hybrid—In this mode, both a low quality copy of the speech content of the audio program (for use in performing waveform-coded speech enhancement on the program), and a parameter set for each speech-containing channel (for use in performing parametric-coded speech enhancement on the program) are transmitted in parallel with the unenhanced mixed (speech and non-speech) audio content of the program. When the bitrate for the low quality copy of the speech is reduced, more coding artifacts become audible in this signal and the bandwidth required for transmitting is reduced. Also transmitted is a blend indicator which determines a combination of waveform-coded speech enhancement and parametric-coded speech enhancement to be performed on each segment of the program using the low quality copy of the speech and the parameter set. At a receiver, hybrid speech enhancement is performed on the program, including by performing a combination of waveform-coded speech enhancement and parametric-coded speech enhancement determined by the blend indicator, thereby generating data indicative of a speech-enhanced audio program. Again, positional data is also transmitted with the unenhanced mixed audio content of the program to indicate where to render the speech signal. An advantage of this approach is that the required receiver/decoder complexity can be reduced if the receiver/decoder discards the low quality copy of the speech and applies only the parameter set to perform parametric-coded enhancement. An example bitrate for transmission of the low quality copy of the speech, parameter set, blend indicator, and positional data is 8-24 kbps per dialog.

For practical reasons the speech enhancement gain may be limited to the 0-12 dB range. An encoder may be implemented to be capable of further reducing the upper limit of this range further by means of a bitstream field. In some embodiments, the syntax of the encoded program (output from the encoder) would support multiple simultaneous enhanceable dialogs (in addition to the program's non-speech content), such that each dialog can be reconstructed and rendered separately. In these embodiments, in the latter modes, speech enhancements for simultaneous dialogs (from multiple sources at different spatial positions) would be rendered at a single position.

In some embodiments in which the encoded audio program is an object-based audio program, one or more (of the maximum total number of) object clusters may be selected for speech enhancement. CLD value pairs may be included in the encoded program for use by the speech enhancement and rendering system to pan the enhanced speech between the object clusters. Similarly, in some embodiments in which the encoded audio program includes speaker channels in a conventional 5.1 format, one or more of the front speaker channels may be selected for speech enhancement.

Another aspect of the invention is a method (e.g., a method performed by decoder 40 of FIG. 3) for decoding and performing hybrid speech enhancement on an encoded audio signal which has been generated in accordance with an embodiment of the inventive encoding method.

The invention may be implemented in hardware, firmware, or software, or a combination of both (e.g., as a programmable logic array). Unless otherwise specified, the algorithms or processes included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems (e.g., a computer system which implements encoder 20 of FIG. 3, or the encoder of FIG. 7, or decoder 40 of FIG. 3), each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

For example, when implemented by computer software instruction sequences, various functions and steps of embodiments of the invention may be implemented by multithreaded software instruction sequences running in suitable digital signal processing hardware, in which case the various devices, steps, and functions of the embodiments may correspond to portions of the software instructions.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be implemented as a computer-readable storage medium, configured with (i.e., storing) a computer program, where the storage medium so configured causes a computer system to operate in a specific and predefined manner to perform the functions described herein.

A number of embodiments of the invention have been described. Nevertheless, it will be understood that various modifications may be made without departing from the spirit and scope of the invention. Numerous modifications and variations of the present invention are possible in light of the above teachings. It is to be understood that within the scope of the appended claims, the invention may be practiced otherwise than as specifically described herein.

6. Mid/Side Representation

Speech enhancement operations as described herein may be performed by an audio decoder based at least in part on control data, control parameters, etc., in the M/S representation. The control data, control parameters, etc., in the M/S representation may be generated by an upstream audio encoder and extracted by the audio decoder from an encoded audio signal generated by the upstream audio encoder.

In a parametric-coded enhancement mode in which speech content (e.g., one or more dialogs, etc.) is predicted from mixed content, the speech enhancement operations may be generally represented with a single matrix, H, as shown in the following expression:

$$\begin{pmatrix} M_{e,c_1} \\ M_{e,c_2} \end{pmatrix} = H \cdot \begin{pmatrix} M_{c_1} \\ M_{c_2} \end{pmatrix} \tag{30}$$

where the left-hand-side (LHS) represents a speech enhanced mixed content signal generated by the speech enhancement operations as represented by the matrix H operating on an original mixed content signal on the right-hand-side (RHS).

For the purpose of illustration, each of the speech enhanced mixed content signal (e.g., the LHS of expression (30), etc.) and the original mixed content signal (e.g., the original mixed content signal operated by H in expression (30), etc.) comprises two component signals having speech enhanced and original mixed content in two channels, $c_1$ and $c_2$, respectively. The two channels $c_i$ and $c_2$ may be non M/S audio channels (e.g., left front channel, right front channel, etc.) based on a non-M/S representation. It should be noted that in various embodiments, each of the speech enhanced mixed content signal and the original mixed content signal may further comprise component signals having non-speech content in channels (e.g., surround channels, a low-frequency-effect channel, etc.) other than the two non-M/S channels $c_1$ and $c_2$. It should be further noted that in various embodiments, each of the speech enhanced mixed content signal and the original mixed content signal may possibly comprise component signals having speech content in one, two, as illustrated in expression (30), or more than two channels. Speech content as described herein may comprise one, two or more dialogs.

In some embodiments, the speech enhancement operations as represented by H in expression (30) may be used (e.g., as directed by an SNR-guided blending rule, etc.) for time slices (segments) of the mixed content with relatively high SNR values between the speech content and other (e.g., non-speech, etc.) content in the mixed content.

The matrix H may be rewritten/expanded as a product of a matrix, $H_{MS}$ representing enhancement operations in the M/S representation, multiplied on the right with a forward transformation matrix from the non-M/S representation to the M/S representation and multiplied on the left with an inverse (which comprises a factor of ½) of the forward transformation matrix, as shown in the following expression:

$$\begin{pmatrix} M_{e,c_1} \\ M_{e,c_2} \end{pmatrix} = \frac{1}{2} \cdot \begin{pmatrix} 1 & 1 \\ 1 & -1 \end{pmatrix} \cdot H_{MS} \cdot \begin{pmatrix} 1 & 1 \\ 1 & -1 \end{pmatrix} \cdot \begin{pmatrix} M_{c_1} \\ M_{c_2} \end{pmatrix} \tag{31}$$

where the example transformation matrix on the right of the matrix $H_{MS}$ defines the mid-channel mixed content signal in the M/S representation as the sum of the two mixed content signals in the two channels $c_1$ and $c_2$, and defines the side-channel mixed content signal in the M/S representation as the difference of the two mixed content signals in the two channels $c_1$ and $c_2$, based on the forward transformation matrix. It should be noted that in various embodiments, other transformation matrixes (e.g., assigning different weights to different non-M/S channels, etc.) other than the example transformation matrixes shown in expression (31) may also be used to transform the mixed content signals from one representation to a different representation. For example, for dialog enhancement with the dialog rendered not in the phantom center but panned between the two signals with unequal weights $\lambda_1$ and $\lambda_2$. The M/S transformation matrices may be modified to minimize the energy of the dialog component in the side signal, as shown in the following expression:

$$\begin{pmatrix} M_{e,c_1} \\ M_{e,c_2} \end{pmatrix} = \frac{1}{2} \cdot \lambda_1 \cdot \lambda_2 \cdot \begin{pmatrix} \frac{1}{\lambda_2} & \frac{1}{\lambda_2} \\ \frac{1}{\lambda_1} & -\frac{1}{\lambda_1} \end{pmatrix} \cdot H_{MS} \cdot \begin{pmatrix} \frac{1}{\lambda_1} & \frac{1}{\lambda_2} \\ \frac{1}{\lambda_1} & -\frac{1}{\lambda_2} \end{pmatrix} \cdot \begin{pmatrix} M_{c_1} \\ M_{c_2} \end{pmatrix} \tag{31A}$$

In an example embodiment, the matrix $H_{MS}$ representing enhancement operations in the M/S representation may be defined as a diagonalized (e.g., Hermitian, etc.) matrix as shown in the following expression:

$$H_{MS} = \begin{pmatrix} g \cdot p_1 + 1 & 0 \\ 0 & g \cdot p_2 + 1 \end{pmatrix} \tag{32}$$

where $p_1$ and $p_2$ represent mid-channel and side-channel prediction parameters, respectively. Each of the prediction parameters $p_1$ and $p_2$ may comprise a time-varying prediction parameter set for time-frequency tiles of a corresponding mixed content signal in the M/S representation to be used for reconstructing speech content from the mixed content signal. The gain parameter g corresponds to a speech enhancement gain, G, for example, as shown in expression (10).

In some embodiments, the speech enhancement operations in the M/S representation are performed in the parametric channel independent enhancement mode. In some embodiments, the speech enhancement operations in the M/S representation are performed with the predicted speech content in both the mid-channel signal and the side-channel signal, or with the predicted speech content in the mid-channel signal only. For the purpose of illustration, the speech enhancement operations in the M/S representation are performed with the mixed content signal in the mid-channel only, as shown in the following expression:

$$H_{MS} = \begin{pmatrix} g \cdot p_1 + 1 & 0 \\ 0 & 1 \end{pmatrix} \tag{33}$$

where the prediction parameter $p_1$ comprises a single prediction parameter set for time-frequency tiles of the mixed content signal in mid-channel of the M/S representation to be used for reconstructing speech content from the mixed content signal in the mid-channel only.

Based on the diagonalized matrix $H_{MS}$ given in expression (33), speech enhancement operations in the parametric enhancement mode, as represented by expression (31), can be further reduced to the following expression, which provides an explicit example of the matrix H in expression (30):

$$\begin{pmatrix} M_{e,c_1} \\ M_{e,c_2} \end{pmatrix} = \frac{1}{2} \cdot \begin{pmatrix} 2 + g \cdot p_1 & g \cdot p_1 \\ g \cdot p_1 & 2 + g \cdot p_1 \end{pmatrix} \cdot \begin{pmatrix} M_{c_1} \\ M_{c_2} \end{pmatrix} \tag{34}$$

In a waveform-parametric hybrid enhancement mode, speech enhancement operations can be represented in the M/S representation with the following example expressions:

$$\begin{aligned} M_e &= g_1 \cdot \begin{pmatrix} d_{c,1} \\ 0 \end{pmatrix} + \begin{pmatrix} g_2 \cdot p_1 + 1 & 0 \\ 0 & 1 \end{pmatrix} \cdot \begin{pmatrix} m_1 \\ m_2 \end{pmatrix} \\ &= H_d \cdot D_c + H_p \cdot M \end{aligned} \tag{35}$$

where $m_1$ and $m_2$ denote the mid-channel mixed content signal (e.g., the sum of the mixed content signals in the non-M/S channels such as left and right front channels, etc.) and the side-channel mixed content signal (e.g., the difference of the mixed content signals in the non-M/S channels such as left and right front channels, etc.), respectively, in a mixed content signal vector M. A signal, $d_{c,1}$ denotes the mid-channel dialog waveform signal (e.g., encoded waveforms representing a reduced version of a dialog in the mixed content, etc.) in a dialog signal vector $D_c$ of the M/S representation. A matrix, $H_d$, represents speech enhancement operations in the M/S representation based on the dialog signal $d_{c,1}$ in the mid-channel of the M/S representation, and may comprise only one matrix element at row 1 and column 1 (1×1). A matrix, $H_p$, represents speech enhancement operations in the M/S representation based on a reconstructed dialog using the prediction parameter $p_1$ for the mid-channel of the M/S representation. In some embodiments, gain parameters $g_1$ and $g_2$ collectively (e.g., after being respectively applied to the dialog waveform signal and the reconstructed dialog, etc.) correspond to a speech enhancement gain, G, for example, as depicted in expressions (23) and (24). Specifically, the parameter $g_1$ is applied in the waveform-coded speech enhancement operations relating to the dialog signal $d_{c,1}$ in the mid-channel of the M/S representation, whereas the parameter $g_2$ is applied in the parametric-coded speech enhancement operations relating to the mixed content signals $m_1$ and $m_2$ in the mid-channel and the side-channel of the M/S representation. Parameters $g_1$ and $g_2$ control the overall enhancement gain and the trade-off between the two speech enhancement methods.

In the non-M/S representation, the speech enhancement operations corresponding to those represented with expression (35) can be represented with the following expressions:

$$\begin{pmatrix} M_{e,c_1} \\ M_{e,c_2} \end{pmatrix} = \frac{1}{2}\cdot\begin{pmatrix} 1 & 1 \\ 1 & -1 \end{pmatrix}\cdot H_d\cdot D_c + \frac{1}{2}\begin{pmatrix} 1 & 1 \\ 1 & -1 \end{pmatrix}\cdot H_p\cdot \begin{pmatrix} 1 & 1 \\ 1 & -1 \end{pmatrix}\cdot\begin{pmatrix} M_{c_1} \\ M_{c_2} \end{pmatrix} = \frac{1}{2}\cdot\begin{pmatrix} 1 & 1 \\ 1 & -1 \end{pmatrix}\cdot\left(H_d\cdot D_c + H_p\cdot\begin{pmatrix} 1 & 1 \\ 1 & -1 \end{pmatrix}\cdot\begin{pmatrix} M_{c_1} \\ M_{c_2} \end{pmatrix}\right) \quad (36)$$

where the mixed content signals $m_1$ and $m_2$ in the M/S representation as shown in expression (35) is replaced with the mixed content signals $M_{c1}$ and $M_{c2}$ in the non-M/S channels left multiplied with the forward transformation matrix between the non-M/S representation and the M/S representation. The inverse transformation matrix (with a factor of ½) in expression (36) converts the speech enhanced mixed content signals in the M/S representation, as shown in expression (35), back to speech enhanced mixed content signals in the non-M/S representation (e.g., left and right front channels, etc.).

Additionally, optionally, or alternatively, in some embodiments in which no further QMF-based processing is done after speech enhancement operations, some or all of the speech enhancement operations (e.g., as represented by $H_d$, $H_p$, transformations, etc.) that combine speech enhanced content based on the dialog signal $d_{c,1}$ and speech enhanced mixed content based on the reconstructed dialog through prediction may be performed after a QMF synthesis filterbank in the time domain for efficiency reasons.

A prediction parameter used to construct/predict speech content from a mixed content signal in one or both of the mid-channel and the side-channel of the M/S representation may be generated based on one of one or more prediction parameter generation methods including but not limited only to, any of: channel-independent dialog prediction methods as depicted in FIG. 1, multichannel dialog prediction methods as depicted in FIG. 2, etc. In some embodiments, at least one of the prediction parameter generation methods may be based on MMSE, gradient descent, one or more other optimization methods, etc.

In some embodiments, a "blind" temporal SNR-based switching method as previously discussed may be used between parametric-coded enhancement data (e.g., relating to speech enhanced content based on the dialog signal $d_{c,1}$, etc.) and waveform-coded enhancement (e.g., relating to speech enhanced mixed content based on the reconstructed dialog through prediction, etc.) of segments of an audio program in the M/S representation.

In some embodiments, a combination (e.g., indicated by a blend indicator previously discussed, a combination of $g_1$ and $g_2$ in expression (35), etc.) of the waveform data (e.g., relating to speech enhanced content based on the dialog signal $d_{c,1}$, etc.) and the reconstructed speech data (e.g., relating to speech enhanced mixed content based on the reconstructed dialog through prediction, etc.) in the M/S representation changes over time, with each state of the combination pertaining to the speech and other audio content of a corresponding segment of the bitstream that carries the waveform data and the mixed content used in reconstructing speech data. The blend indicator is generated such that the current state of the combination (of waveform data and reconstructed speech data) is determined by signal properties of the speech and other audio content (e.g., a ratio of the power of speech content and the power of other audio content, a SNR, etc.) in the corresponding segment of the program. The blend indicator for a segment of an audio program may be a blend indicator parameter (or parameter set) generated in subsystem 29 of the encoder of FIG. 3 for the segment. An auditory masking model as previously discussed may be used to predict more accurately how coding noises in the reduced quality speech copy in the dialog signal vector Dc is being masked by the audio mix of the main program and to select the blending ratio accordingly.

Subsystem 28 of encoder 20 of FIG. 3 may be configured to include blend indicators relating to M/S speech enhancement operations in the bitstream as a part of the M/S speech enhancement metadata to be output from encoder 20. Blend indicators relating to M/S speech enhancement operations may be generated (e.g., in subsystem 13 of the encoder of FIG. 7) from scaling factors $g_{max}(t)$ relating to coding artifacts in the dialog signal Dc, etc. The scaling factors $g_{max}(t)$ may be generated by subsystem 14 of the FIG. 7 encoder. Subsystem 13 of the FIG. 7 encoder may be configured to include the blend indicators in the bitstream to be output from the FIG. 7 encoder. Additionally, optionally, or alternatively, subsystem 13 may include, in the bitstream to be output from the FIG. 7 encoder, the scaling factors $g_{max}(t)$ generated by subsystem 14.

In some embodiments, the unenhanced audio mix, A(t), generated by operation 10 of FIG. 7 represents (e.g., time segments of, etc.) a mixed content signal vector in the reference audio channel configuration. The parametric-coded enhancement parameters, p(t), generated by element 12 of FIG. 7 represents at least a part of M/S speech enhancement metadata for performing parametric-coded speech enhancement in the M/S representation with respect to each segment of the mixed content signal vector. In some embodiments, the reduced quality speech copy, s'(t), generated by coder 15 of FIG. 7 represents a dialog signal vector in the M/S representation (e.g., with the mid-channel dialog signal, the side-channel dialog signal, etc.).

In some embodiments, element 14 of FIG. 7 generates the scaling factors, $g_{max}(t)$, and provides them to encoding element 13. In some embodiments, element 13 generates an encoded audio bitstream indicative of the (e.g., unenhanced, etc.) mixed content signal vector in the reference audio channel configuration, the M/S speech enhancement metadata, the dialog signal vector in the M/S representation if applicable, and the scaling factors $g_{max}(t)$ if applicable, for each segment of the audio program, and this encoded audio bitstream may be transmitted or otherwise delivered to a receiver.

When the unenhanced audio signal in a non-M/S representation is delivered (e.g., transmitted) with M/S speech enhancement metadata to a receiver, the receiver may transform each segment of the unenhanced audio signal in the M/S representation and perform M/S speech enhancement operations indicated by the M/S speech enhancement metadata for the segment. The dialog signal vector in the M/S representation for a segment of program can be provided with the unenhanced mixed content signal vector in the non-M/S representation if speech enhancement operations for the segment are to be performed in the hybrid speech enhancement mode, or in the waveform-coded enhancement mode. If applicable, a receiver which receives and parses the bitstream may be configured to generate the blend indicators in response to the scaling factors $g_{max}(t)$ and determine the gain parameters $g_1$ and $g_2$ in expression (35).

In some embodiments, speech enhancement operations are performed at least partially in the M/S representation in a receiver to which the encoded output of element 13 has been delivered. In an example, on each segment of the unenhanced mixed content signal, the gain parameters $g_1$ and $g_2$ in expression (35) corresponding to a predetermined (e.g., requested) total amount of enhancement may be applied based at least in part on blending indicators parsed from the bitstream received by the receiver. In another example, on each segment of the unenhanced mixed content signal, the gain parameters $g_1$ and $g_2$ in expression (35) corresponding to a predetermined (e.g., requested) total amount of enhancement may be applied based at least in part on blending indicators as determined from scale factors $g_{max}(t)$ for the segment parsed from the bitstream received by the receiver.

In some embodiments, element 23 of encoder 20 of FIG. 3 is configured to generate parametric data including M/S speech enhancement metadata (e.g., prediction parameters to reconstruct dialog/speech content from mixed content in the mid-channel and/or in the side-channel, etc.) in response to data output from stages 21 and 22. In some embodiments, blend indicator generation element 29 of encoder 20 of FIG. 3 is configured to generate a blend indicator ("BI") to determining a combination of parametrically speech enhanced content (e.g., with the gain parameter $g_1$, etc.) and waveform-based speech enhanced content (e.g., with the gain parameter $g_1$, etc.) in response to the data output from stages 21 and 22.

In variations on the FIG. 3 embodiment, the blend indicator employed for M/S hybrid speech enhancement is not generated in the encoder (and is not included in the bitstream output from the encoder), but is instead generated (e.g., in a variation on receiver 40) in response to the bitstream output from the encoder (which bitstream does includes waveform data in the M/S channels and M/S speech enhancement metadata).

Decoder 40 is coupled and configured (e.g., programmed) to receive the encoded audio signal from subsystem 30 (e.g., by reading or retrieving data indicative of the encoded audio signal from storage in subsystem 30, or receiving the encoded audio signal that has been transmitted by subsystem 30), and to decode data indicative of mixed (speech and non-speech) content signal vector in the reference audio channel configuration from the encoded audio signal, and to perform speech enhancement operations at least in part in the M/S representation on the decoded mixed content in the reference audio channel configuration. Decoder 40 may be configured to generate and output (e.g., to a rendering system, etc.) a speech-enhanced, decoded audio signal indicative of speech-enhanced mixed content.

Figure 6A:
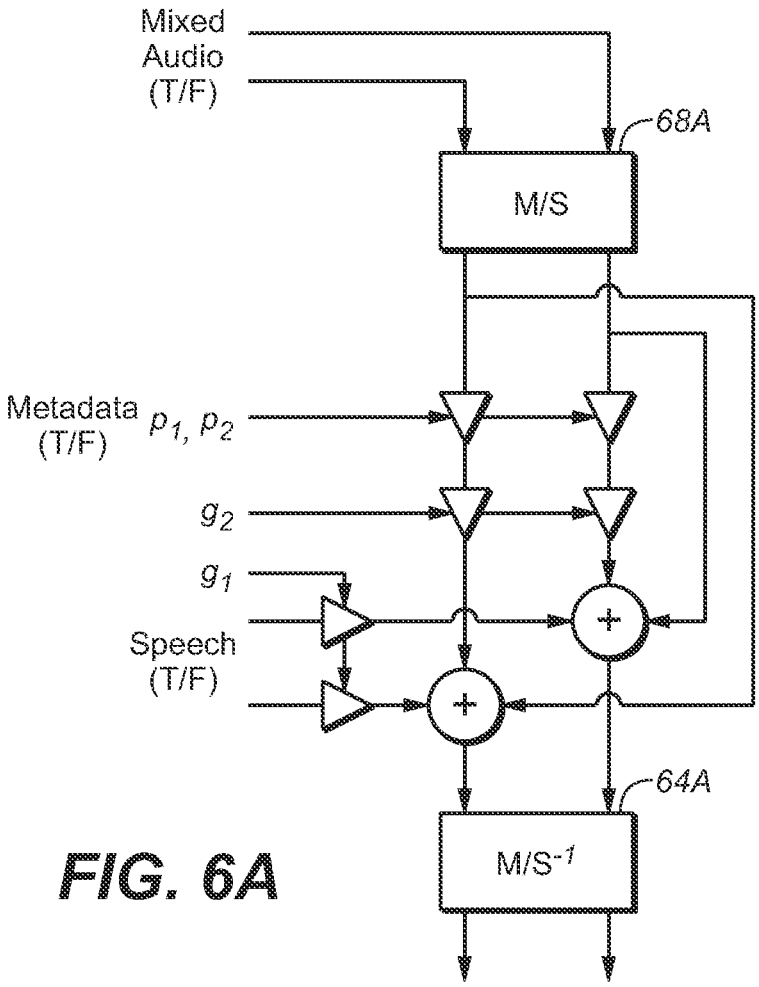

In some embodiments, some or all of the rendering systems depicted in FIG. 4 through FIG. 6 may be configured to render speech enhanced mixed content generated by M/S speech enhancement operations at least some of which are operations performed in the M/S representation. FIG. 6A illustrates an example rendering system configured to perform the speech enhancement operations as represented in expression (35).

The rendering system of FIG. 6A may be configured to perform parametric speech enhancement operations in response to determining that at least one gain parameter (e.g., $g_2$ in expression (35), etc.) used in the parametric speech enhancement operations is non-zero (e.g., in hybrid enhancement mode, in parametric enhancement mode, etc.). For example, upon such a determination, subsystem 68A of FIG. 6A can be configured to perform a transformation on a mixed content signal vector ("mixed audio (T/F)") that is distributed over non-M/S channels to generate a corresponding mixed content signal vector that is distributed over M/S channels. This transformation may use a forward transformation matrix as appropriate. Prediction parameters (e.g., $p_1$, $p_2$, etc.), gain parameters (e.g., $g_2$ in expression (35), etc.) for parametric enhancement operations may be applied to predict speech content from the mixed content signal vector of the M/S channels and enhance the predicted speech content.

The rendering system of FIG. 6A may be configured to perform waveform-coded speech enhancement operations in response to determining that at least one gain parameter (e.g., $g_1$ in expression (35), etc.) used in the waveform-coded speech enhancement operations is non-zero (e.g., in hybrid enhancement mode, in waveform-coded enhancement mode, etc.). For example, upon such a determination, the rendering system of FIG. 6A can be configured to receive/extract, from the received encoded audio signal, a dialog signal vector (e.g., with a reduced version of speech content present in the mixed content signal vector) that is distributed over M/S channels. Gain parameters (e.g., $g_1$ in expression (35), etc.) for waveform-coded enhancement operations may be applied to enhance speech content represented by the dialog signal vector of the M/S channels. A user-definable enhancement gain (G) may be used to derive gain parameters g1 and g2 using a blending parameter, which may or may not be present in the bitstream. In some embodiments, the blending parameter to be used with the user-definable enhancement gain (G) to derive gain parameters g1 and g2 can be extracted from metadata in the received encoded audio signal. In some other embodiments, such a blending parameter may not be extracted from metadata in the received encoded audio signal, but rather can be derived by a recipient encoder based on the audio content in the received encoded audio signal.

In some embodiments, a combination of the parametrical enhanced speech content and the waveform-coded enhanced speech content in the M/S representation is asserted or inputted to subsystem 64A of FIG. 6A. Subsystem 64A of FIG. 6 can be configured to perform a transformation on the combination of enhanced speech content that is distributed over M/S channels to generate an enhanced speech content signal vector that is distributed over non-M/S channels. This transformation may use an inverse transformation matrix as appropriate. The enhanced speech content signal vector of the non-M/S channels may be combined with the mixed content signal vector ("mixed audio (T/F)") that is distributed over the non-M/S channels to generate a speech enhanced mixed content signal vector.

In some embodiments, the syntax of the encoded audio signal (e.g., output from encoder 20 of FIG. 3, etc.) supports a transmission of an M/S flag from an upstream audio encoder (e.g., encoder 20 of FIG. 3, etc.) to downstream audio decoders (e.g., decoder 40 of FIG. 3, etc.). The M/S flag is present/set by the audio encoder (e.g., element 23 in encoder 20 of FIG. 3, etc.) when speech enhancement operations are to be performed by a recipient audio decoder (e.g., decoder 40 of FIG. 3, etc.) at least in part with M/S control data, control parameters, etc., that are transmitted with the M/S flag. For example, when the M/S flag is set, a stereo signal (e.g., from left and right channels, etc.) in non-M/S channels may be first transformed by the recipient audio decoder (e.g., decoder 40 of FIG. 3, etc.) to the mid-channel and the side-channel of the M/S representation before applying M/S speech enhancement operations with the M/S control data, control parameters, etc., as received with the M/S flag, according to one or more of speech enhancement algorithms (e.g., channel-independent dialog prediction, multichannel dialog prediction, waveform-based, waveform-parametric hybrid, etc.). In the recipient audio decoder (e.g., decoder 40 of FIG. 3, etc.), after the M/S speech enhancement operations are performed, the speech enhanced signals in the M/S representation may be transformed back to the non-M/S channels.

In some embodiments, speech enhancement metadata generated by an audio encoder (e.g., encoder 20 of FIG. 3, element 23 of encoder 20 of FIG. 3, etc.) as described herein can carry one or more specific flags to indicate the presence of one or more sets of speech enhancement control data, control parameters, etc., for one or more different types of speech enhancement operations. The one or more sets of speech enhancement control data, control parameters, etc., for the one or more different types of speech enhancement operations may, but are not limited to only, include a set of M/S control data, control parameters, etc., as M/S speech enhancement metadata. The speech enhancement metadata may also include a preference flag to indicate which type of speech enhancement operations (e.g., M/S speech enhancement operations, non-M/S speech enhancement operations, etc.) is preferred for the audio content to be speech enhanced. The speech enhancement metadata may be delivered to a downstream decoder (e.g., decoder 40 of FIG. 3, etc.) as a part of metadata delivered in an encoded audio signal that includes mixed audio content encoded for a non-M/S reference audio channel configuration. In some embodiments, only M/S speech enhancement metadata but not non-M/S speech enhancement metadata is included in the encoded audio signal.

Additionally, optionally, or alternatively, an audio decoder (e.g., 40 of FIG. 3, etc.) can be configured to determine and perform a specific type (e.g., M/S speech enhancement, non-M/S speech enhancement, etc.) of speech enhancement operations based on one or more factors. These factors may include, but are not limited only to: one or more of user input that specifies a preference for a specific user-selected type of speech enhancement operation, user input that specifies a preference for a system-selected type of speech enhancement operations, capabilities of the specific audio channel configuration operated by the audio decoder, availability of speech enhancement metadata for the specific type of speech enhancement operation, any encoder-generated preference flag for a type of speech enhancement operation, etc. In some embodiments, the audio decoder may implement one or more precedence rules, may solicit further user input, etc., to determine a specific type of speech enhancement operation if these factors conflict among themselves.

7. Example Process Flows

Figure 8A:
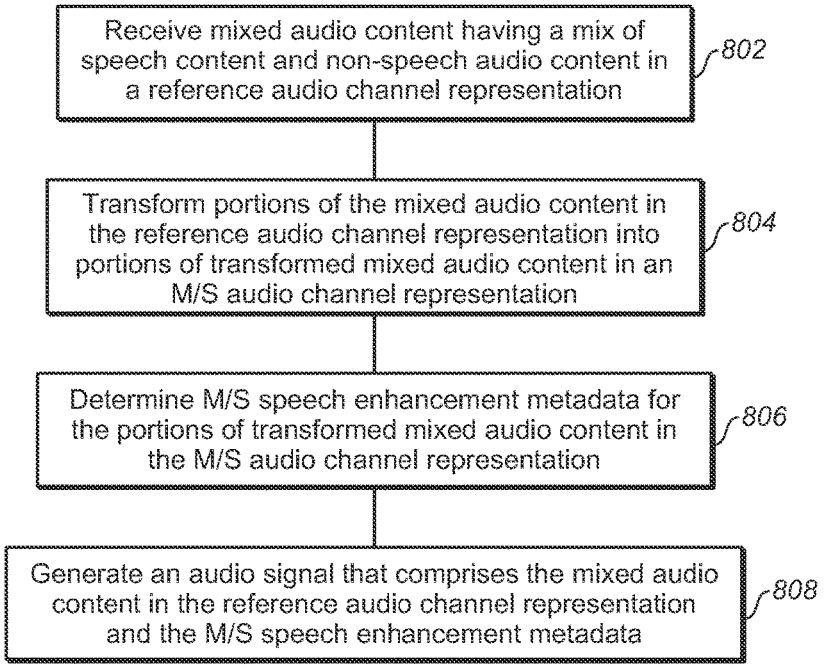
FIG. 8A and FIG. 8B illustrate example process flows.
Figure 8B:
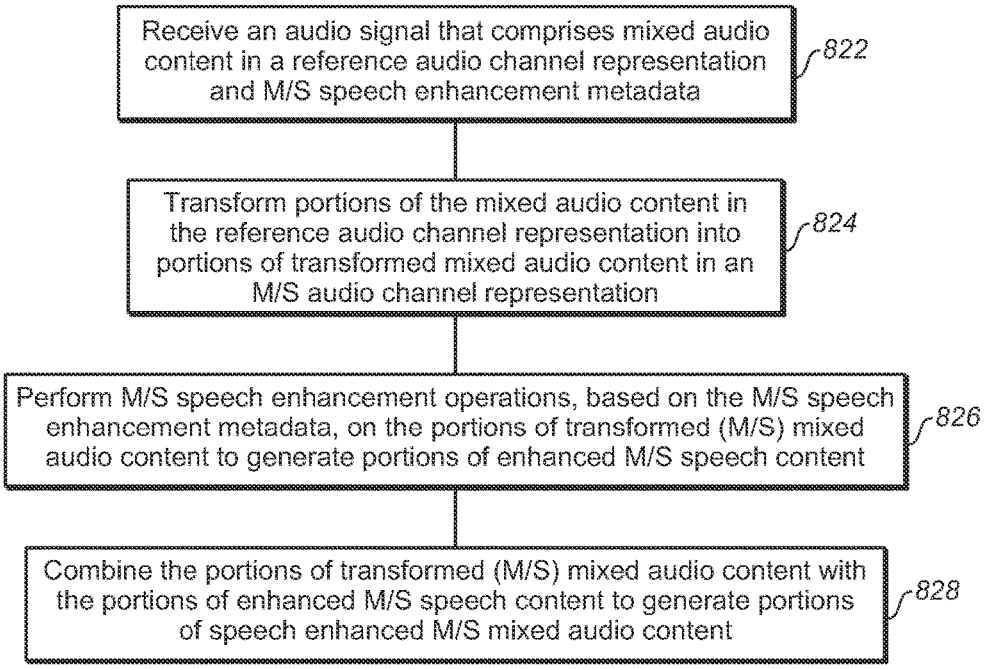

FIG. 8A and FIG. 8B illustrate example process flows. In some embodiments, one or more computing devices or units in a media processing system may perform this process flow.

FIG. 8A illustrates an example process flow that may be implemented by an audio encoder (e.g., encoder 20 of FIG. 3) as described herein. In block 802 of FIG. 8A, the audio encoder receives mixed audio content, having a mix of speech content and non-speech audio content, in a reference audio channel representation, that is distributed over a plurality of audio channels of the reference audio channel representation.

In block 804, the audio encoder transforms one or more portions of the mixed audio content that are distributed over one or more non-Mid/Side (M/S) channels in the plurality of audio channels of the reference audio channel representation into one or more portions of transformed mixed audio content in an M/S audio channel representation that are distributed over one or more M/S channels of the M/S audio channel representation.

In block 806, the audio encoder determines M/S speech enhancement metadata for the one or more portions of transformed mixed audio content in the M/S audio channel representation.

In block 808, the audio encoder generates an audio signal that comprises the mixed audio content in the reference audio channel representation and the M/S speech enhancement metadata for the one or more portions of transformed mixed audio content in the M/S audio channel representation.

In an embodiment, the audio encoder is further configured to perform: generating a version of the speech content, in the M/S audio channel representation, separate from the mixed audio content; and outputting the audio signal encoded with the version of the speech content in the M/S audio channel representation.

In an embodiment, the audio encoder is further configured to perform: generating blend indicating data that enables a recipient audio decoder to apply speech enhancement to the mixed audio content with a specific quantitative combination of waveform-coded speech enhancement based on the version of the speech content in the M/S audio channel representation and parametric speech enhancement based on a reconstructed version of the speech content in the M/S audio channel representation; and outputting the audio signal encoded with the blend indicating data.

In an embodiment, the audio encoder is further configured to prevent encoding the one or more portions of transformed mixed audio content in the M/S audio channel representation as a part of the audio signal.

FIG. 8B illustrates an example process flow that may be implemented by an audio decoder (e.g., decoder 40 of FIG. 3) as described herein. In block 822 of FIG. 8B, the audio decoder receives an audio signal that comprises mixed audio content in a reference audio channel representation and Mid/Side (M/S) speech enhancement metadata.

In block 824 of FIG. 8B, the audio decoder transforms one or more portions of the mixed audio content that are distributed over one, two or more non-M/S channels in a plurality of audio channels of the reference audio channel representation into one or more portions of transformed mixed audio content in an M/S audio channel representation that are distributed over one or more M/S channels of the M/S audio channel representation.

In block 826 of FIG. 8B, the audio decoder performs one or more M/S speech enhancement operations, based on the M/S speech enhancement metadata, on the one or more portions of transformed mixed audio content in the M/S audio channel representation to generate one or more portions of enhanced speech content in the M/S representation.

In block 828 of FIG. 8B, the audio decoder combines the one or more portions of transformed mixed audio content in the M/S audio channel representation with the one or more of enhanced speech content in the M/S representation to generate one or more portions of speech enhanced mixed audio content in the M/S representation.

In an embodiment, the audio decoder is further configured to inversely transform the one or more portions of speech enhanced mixed audio content in the M/S representation to one or more portions of speech enhanced mixed audio content in the reference audio channel representation.

In an embodiment, the audio decoder is further configured to perform: extracting a version of the speech content, in the M/S audio channel representation, separate from the mixed audio content from the audio signal; and performing one or more speech enhancement operations, based on the M/S speech enhancement metadata, on one or more portions of the version of the speech content in the M/S audio channel representation to generate one or more second portions of enhanced speech content in the M/S audio channel representation.

In an embodiment, the audio decoder is further configured to perform: determining blend indicating data for speech enhancement; and generating, based on the blend indicating data for speech enhancement, a specific quantitative combination of waveform-coded speech enhancement based on the version of the speech content in the M/S audio channel representation and parametric speech enhancement based on a reconstructed version of the speech content in the M/S audio channel representation.

In an embodiment, the blend indicating data is generated based at least in part on one or more SNR values for the one or more portions of transformed mixed audio content in the M/S audio channel representation. The one or more SNR values represents one or more of ratios of power of speech content and non-speech audio content of the one or more portions of transformed mixed audio content in the M/S audio channel representation, or ratios of power of speech content and total audio content of the one or more portions of transformed mixed audio content in the M/S audio channel representation.

In an embodiment, the specific quantitative combination of waveform-coded speech enhancement based on the version of the speech content in the M/S audio channel representation and parametric speech enhancement based on a reconstructed version of the speech content in the M/S audio channel representation is determined with an auditory masking model in which the waveform-coded speech enhancement based on the version of the speech content in the M/S audio channel representation represents a greatest relative amount of speech enhancement in a plurality of combinations of waveform-coded speech enhancements and the parametric speech enhancement that ensures that coding noise in an output speech-enhanced audio program is not objectionably audible.

In an embodiment at least a portion of the M/S speech enhancement metadata enables a recipient audio decoder to reconstruct a version of the speech content in the M/S representation from the mixed audio content in the reference audio channel representation.

In an embodiment, the M/S speech enhancement metadata comprises metadata relating to one or more of waveform-coded speech enhancement operations in the M/S audio channel representation, or parametric speech enhancement operations in the M/S audio channel.

In an embodiment, the reference audio channel representation comprises audio channels relating to surround speakers. In an embodiment, the one or more non-M/S channels of the reference audio channel representation comprise one or more of a center channel, a left channel, or a right channel, whereas the one or more M/S channels of the M/S audio channel representation comprise one or more of a mid-channel or a side-channel.

In an embodiment, the M/S speech enhancement metadata comprises a single set of speech enhancement metadata relating to a mid-channel of the M/S audio channel representation. In an embodiment, the M/S speech enhancement metadata represents a part of overall audio metadata encoded in the audio signal. In an embodiment, audio metadata encoded in the audio signal comprises a data field to indicate a presence of the M/S speech enhancement metadata. In an embodiment, the audio signal is a part of an audiovisual signal.

In an embodiment, an apparatus comprising a processor is configured to perform any one of the methods as described herein.

In an embodiment, a non-transitory computer readable storage medium, comprising software instructions, which when executed by one or more processors cause performance of any one of the methods as described herein. Note that, although separate embodiments are discussed herein, any combination of embodiments and/or partial embodiments discussed herein may be combined to form further embodiments.

8. Implementation Mechanisms—Hardware Overview

According to one embodiment, the techniques described herein are implemented by one or more special-purpose computing devices. The special-purpose computing devices may be hard-wired to perform the techniques, or may include digital electronic devices such as one or more application-specific integrated circuits (ASICs) or field programmable gate arrays (FPGAs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices or any other device that incorporates hard-wired and/or program logic to implement the techniques.

Figure 9:
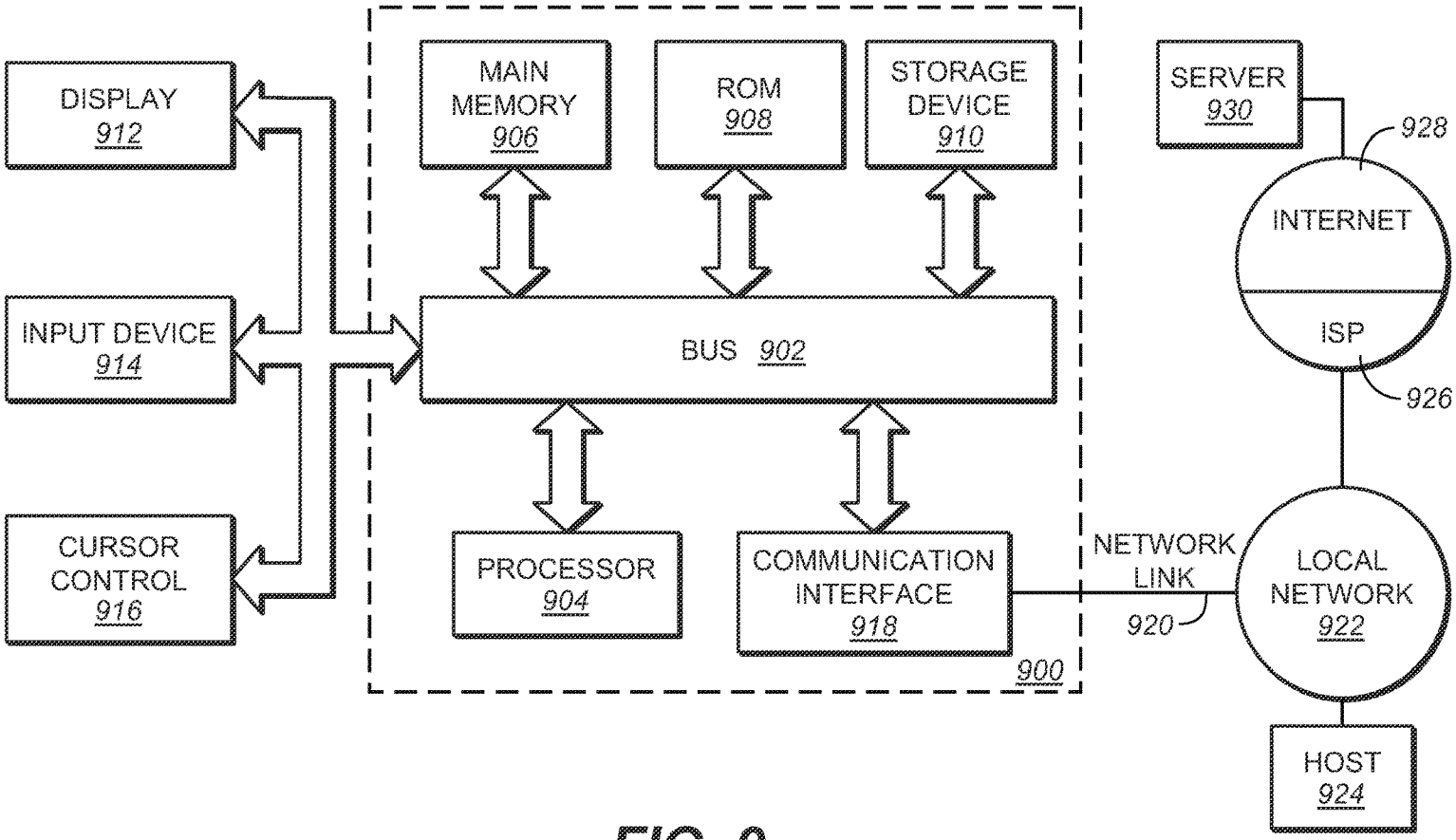
FIG. 9 illustrates an example hardware platform on which a computer or a computing device as described herein may be implemented.

For example, FIG. 9 is a block diagram that illustrates a computer system 900 upon which an embodiment of the invention may be implemented. Computer system 900 includes a bus 902 or other communication mechanism for communicating information, and a hardware processor 904 coupled with bus 902 for processing information. Hardware processor 904 may be, for example, a general purpose microprocessor.

Computer system 900 also includes a main memory 906, such as a random access memory (RAM) or other dynamic storage device, coupled to bus 902 for storing information and instructions to be executed by processor 904. Main memory 906 also may be used for storing temporary variables or other intermediate information during execution of instructions to be executed by processor 904. Such instructions, when stored in non-transitory storage media accessible to processor 904, render computer system 900 into a special-purpose machine that is device-specific to perform the operations specified in the instructions.

Computer system 900 further includes a read only memory (ROM) 908 or other static storage device coupled to bus 902 for storing static information and instructions for processor 904. A storage device 910, such as a magnetic disk or optical disk, is provided and coupled to bus 902 for storing information and instructions.

Computer system 900 may be coupled via bus 902 to a display 912, such as a liquid crystal display (LCD), for displaying information to a computer user. An input device 914, including alphanumeric and other keys, is coupled to bus 902 for communicating information and command selections to processor 904. Another type of user input device is cursor control 916, such as a mouse, a trackball, or cursor direction keys for communicating direction information and command selections to processor 904 and for controlling cursor movement on display 912. This input device typically has two degrees of freedom in two axes, a first axis (e.g., x) and a second axis (e.g., y), that allows the device to specify positions in a plane.

Computer system 900 may implement the techniques described herein using device-specific hard-wired logic, one or more ASICs or FPGAs, firmware and/or program logic which in combination with the computer system causes or programs computer system 900 to be a special-purpose machine. According to one embodiment, the techniques herein are performed by computer system 900 in response to processor 904 executing one or more sequences of one or more instructions contained in main memory 906. Such instructions may be read into main memory 906 from another storage medium, such as storage device 910. Execution of the sequences of instructions contained in main memory 906 causes processor 904 to perform the process steps described herein. In alternative embodiments, hard-wired circuitry may be used in place of or in combination with software instructions.

The term "storage media" as used herein refers to any non-transitory media that store data and/or instructions that cause a machine to operation in a specific fashion. Such storage media may comprise non-volatile media and/or volatile media. Non-volatile media includes, for example, optical or magnetic disks, such as storage device 910. Volatile media includes dynamic memory, such as main memory 906. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge.

Storage media is distinct from but may be used in conjunction with transmission media. Transmission media participates in transferring information between storage media. For example, transmission media includes coaxial cables, copper wire and fiber optics, including the wires that comprise bus 902. Transmission media can also take the form of acoustic or light waves, such as those generated during radio-wave and infra-red data communications.

Various forms of media may be involved in carrying one or more sequences of one or more instructions to processor 904 for execution. For example, the instructions may initially be carried on a magnetic disk or solid state drive of a remote computer. The remote computer can load the instructions into its dynamic memory and send the instructions over a telephone line using a modem. A modem local to computer system 900 can receive the data on the telephone line and use an infra-red transmitter to convert the data to an infra-red signal. An infra-red detector can receive the data carried in the infra-red signal and appropriate circuitry can place the data on bus 902. Bus 902 carries the data to main memory 906, from which processor 904 retrieves and executes the instructions. The instructions received by main memory 906 may optionally be stored on storage device 910 either before or after execution by processor 904.

Computer system 900 also includes a communication interface 918 coupled to bus 902. Communication interface 918 provides a two-way data communication coupling to a network link 920 that is connected to a local network 922. For example, communication interface 918 may be an integrated services digital network (ISDN) card, cable modem, satellite modem, or a modem to provide a data communication connection to a corresponding type of telephone line. As another example, communication interface 918 may be a local area network (LAN) card to provide a data communication connection to a compatible LAN. Wireless links may also be implemented. In any such implementation, communication interface 918 sends and receives electrical, electromagnetic or optical signals that carry digital data streams representing various types of information.

Network link 920 typically provides data communication through one or more networks to other data devices. For example, network link 920 may provide a connection through local network 922 to a host computer 924 or to data equipment operated by an Internet Service Provider (ISP) 926. ISP 926 in turn provides data communication services through the world wide packet data communication network now commonly referred to as the "Internet" 928. Local network 922 and Internet 928 both use electrical, electromagnetic or optical signals that carry digital data streams. The signals through the various networks and the signals on network link 920 and through communication interface 918, which carry the digital data to and from computer system 900, are example forms of transmission media.

Computer system 900 can send messages and receive data, including program code, through the network(s), network link 920 and communication interface 918. In the Internet example, a server 930 might transmit a requested code for an application program through Internet 928, ISP 926, local network 922 and communication interface 918.

The received code may be executed by processor 904 as it is received, and/or stored in storage device 910, or other non-volatile storage for later execution.

9. Equivalents, Extensions, Alternatives and Miscellaneous

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, feature, feature, advantage or attribute that is not expressly recited in a claim should limit the scope of such claim in any way. The specification and drawings are, accordingly, to be regarded in an illustrative rather than a restrictive sense.

What is claimed is:

1. A method, comprising:

receiving mixed audio content, in a reference audio channel representation, that are distributed over a plurality of audio channels of the reference audio channel representation, the mixed audio content having a mix of speech content and non-speech audio content;

transforming one or more portions of the mixed audio content that are distributed over two or more non-Mid/Side (non-M/S) channels in the plurality of audio channels of the reference audio channel representation into one or more portions of the transformed mixed audio content in an M/S audio channel representation that are distributed over one or more channels of the M/S audio channel representation, wherein the M/S audio channel representation comprises at least a mid-channel signal and a side-channel signal, wherein the mid-channel signal represents a weighted or non-weighted sum of two channels of the reference audio channel representation, and wherein the side-channel signal represents a weighted or non-weighted difference of two channels of the reference audio channel representation;

determining metadata for speech enhancement of the one or more portions of the transformed mixed audio content in the M/S audio channel representation, wherein a first type of speech enhancement is waveform-encoded speech enhancement of a reduced quality version of the mid-channel signal in the M/S audio channel representation, and a second type of speech enhancement is parametric-encoded speech enhancement of a reconstructed version of the mid-channel signal in the M/S audio channel representation, the metadata including a mid-channel prediction parameter to reconstruct the mid-channel signal, a first gain parameter for waveform-encoded speech enhancement of the mid-channel signal, and a second gain parameter for parametric-encoded speech enhancement of the reconstructed mid-channel signal; and generating an audio signal that comprises the mixed audio content and the metadata for speech enhancement of the one or more portions of the transformed mixed audio content in the M/S audio channel representation;

wherein the method is performed by one or more computing devices.

2. The method of claim 1, wherein the mixed audio content is in a non-M/S audio channel representation.

3. The method of claim 1, further comprising:

generating a version of the speech content, in the M/S audio channel representation, separate from the mixed audio content; and outputting the audio signal encoded with the version of the speech content in the M/S audio channel representation.

4. The method of claim 3, further comprising:

generating blend indicating data indicating a specific quantitative combination of the first and second types of speech enhancement to be generated by a recipient audio decoder; and outputting the audio signal encoded with the blend indicating data.

5. The method of claim 4, wherein the blend indicating data is generated based at least in part on one or more signal-to-noise (SNR) values for the one or more portions of the transformed mixed audio content in the M/S audio channel representation, wherein the one or more SNR values represents one or more of ratios of power of speech content and non-speech audio content of the one or more portions of the transformed mixed audio content in the M/S audio channel representation, or ratios of power of speech content and total audio content of the one or more portions of the transformed mixed audio content in the M/S audio channel representation.

6. The method of claim 4, wherein the specific quantitative combination of the first and second types of speech enhancement is determined with an auditory masking model in which the first type of speech enhancement represents a greatest relative amount of speech enhancement in a plurality of combinations of the first and second types of speech enhancement that ensures that coding noise in an output speech-enhanced audio program is not objectionably audible.

7. A method, comprising:

receiving an audio signal that comprises mixed audio content in a reference audio channel representation and metadata for speech enhancement, the mixed audio content having a mix of speech content and non-speech audio content;

transforming one or more portions of the mixed audio content that spread over two or more non-M/S channels in a plurality of audio channels of the reference audio channel representation into one or more portions of transformed mixed audio content in an M/S audio channel representation that spread over one or more M/S channels of the M/S audio channel representation, wherein the M/S audio channel representation comprises at least a mid-channel signal and a side-channel signal, wherein the mid-channel signal represents a weighted or non-weighted sum of two channels of the reference audio channel representation, and wherein the side-channel signal represents a weighted or non-weighted difference of two channels of the reference audio channel representation;

determining metadata for speech enhancement of the one or more portions of the transformed mixed audio content in the M/S audio channel representation, wherein a first type of speech enhancement is waveform-encoded speech enhancement of a reduced quality version of the mid-channel signal in the M/S audio channel representation, and a second type of speech enhancement is parametric-encoded speech enhancement of a reconstructed version of the mid-channel signal in the M/S audio channel representation, the metadata including a mid-channel prediction parameter to reconstruct the mid-channel signal, a first gain parameter for waveform-encoded speech enhancement of the mid-channel signal, and a second gain parameter for parametric-encoded speech enhancement of the reconstructed mid-channel signal;

performing one or more speech enhancement operations, based on the metadata for speech enhancement, on the one or more portions of the transformed mixed audio content in the M/S audio channel representation to generate one or more portions of enhanced speech content in the M/S representation;

combining the one or more portions of the transformed mixed audio content in the M/S audio channel representation with the one or more portions of the enhanced speech content in the M/S representation to generate one or more portions of speech enhanced mixed audio content in the M/S representation;

wherein the method is performed by one or more computing devices.

8. The method of claim 7, wherein the one or more speech enhancement operations are represented by a single matrix.

9. An apparatus comprising a processor and configured to perform the method recited in claim 1.

10. A non-transitory computer readable storage medium, comprising software instructions, which when executed by one or more processors cause performance of the method recited in claim 1.

11. An apparatus comprising a processor and configured to perform the method recited in claim 7.

12. A non-transitory computer readable storage medium, comprising software instructions, which when executed by one or more processors cause performance of the method recited in claim 7.

* * * * *